US006298698B1

(12) United States Patent
Nakajima et al.

(10) Patent No.: US 6,298,698 B1
(45) Date of Patent: Oct. 9, 2001

(54) BUTTON LOCK

(75) Inventors: Susumu Nakajima; Koichi Takahashi, both of Saitama-ken (JP)

(73) Assignee: Co Kabushikikaisha Nagasawa Seisakusho, Saitama-ken (JP)

( * ) Notice: Subject to any disclaimer, the term of this patent is extended or adjusted under 35 U.S.C. 154(b) by 0 days.

(21) Appl. No.: 09/265,547

(22) Filed: Mar. 9, 1999

(30) Foreign Application Priority Data

Mar. 9, 1998 (JP) ..... 10-073039

(51) Int. Cl.[7] ..... E05B 13/00; E05B 37/16
(52) U.S. Cl. ..... 70/214; 70/298; 70/299
(58) Field of Search ..... 70/214, 297–300, 70/287–290

(56) References Cited

U.S. PATENT DOCUMENTS

| | | | | |
|---|---|---|---|---|
| 225,490 | * | 3/1880 | Reno | 70/297 |
| 399,002 | * | 3/1889 | Becht | 70/300 |
| 448,175 | * | 3/1891 | Wilson | 70/214 |
| 487,138 | * | 11/1892 | Vanwart | 70/297 |
| 1,092,733 | * | 4/1914 | McCarthy | 70/214 |
| 1,372,490 | * | 3/1921 | Dovgall | 70/297 |
| 1,500,657 | * | 7/1924 | Stolberg | 70/214 |
| 1,530,861 | * | 3/1925 | Standen | 70/214 |
| 2,598,457 | * | 5/1952 | Solev Capdevila | 70/299 |
| 2,920,473 | * | 1/1960 | Hansen | 70/214 X |
| 4,541,260 | * | 9/1985 | Rubinstein et al. | 70/288 X |
| 4,827,743 | * | 5/1989 | Kim | 70/214 |
| 4,936,894 | * | 6/1990 | Larson et al. | 70/298 |

FOREIGN PATENT DOCUMENTS

| | | | | |
|---|---|---|---|---|
| 323480 | * | 11/1902 | (FR) | 70/299 |
| 2530717 | * | 1/1984 | (FR) | 70/288 |
| 9268 | * | 6/1889 | (GB) | 70/298 |
| 635915 | * | 4/1950 | (GB) | 70/299 |
| 6254951 | | 11/1987 | (JP) . | |
| 3913 | | 1/1991 | (JP) . | |
| 666055 | | 3/1994 | (JP) . | |
| 232796 | * | 4/1969 | (SU) | 70/214 |

* cited by examiner

*Primary Examiner*—Lloyd A. Gall
(74) *Attorney, Agent, or Firm*—Browdy and Neimark

(57) ABSTRACT

In a door-mounted button lock a stored condition or a non-stored condition is selected by rotating button bodies inserted in a case frame. A screwdriver notch 56 is slotted in one end of a button body 54 for optionally selecting the stored or non-stored condition; a lock flange 57 holds each button body in a locked condition when depressed; upper and lower fan-shaped stopper flanges 60 and 60' have different phases in a 180° peripheral direction; a shank 55' having a square cross section is integrally formed for sliding relative to a slide notch 37 of a key plate 40; and the lever handle can be rotated relative to the rotation shaft 77 via a snap washer 84 to prevent extraction. The stored or non-stored condition can be optionally selected in accordance with the button keyword by rotating the screwdriver notch 180°. The key plate can slide over a wide range of rotation angles of an engagement portion for permitting the key plate to slide to decreased wear. A lever handle 7' can be fixed with a screw 85' relative to a rotation shaft 77 for right-handed or left-handed operation.

10 Claims, 15 Drawing Sheets

BUTTON LOCK

FIELD OF THE INVENTION

The invention relates to a keyless type button lock in which a house door or another door can be locked or unlocked by operating a button.

REVIEW OF THE RELATED TECHNOLOGY

There are various fastening/unfastening locks for use in a building door or the like, but most locks are so-called deadlocks of cylinder-lock type operated by keys. To lock/unlock a warehouse door or the like whose appearance is not important, a so-called number lock is often used, but usually a key-operated system is overwhelmingly used not only for housing but also for business purposes, as a general embedded type of deadlock.

In the key-operated system of the deadlock or other lock, however, a predetermined combination of a lock and a key including a master key is adapted to function literally as a unity. Therefore, once the key is lost, an intrinsic function is also disadvantageously lost. Furthermore, statistics show that there are remarkably many cases in which locking/unlocking is impossible because the key is forgotten. These disadvantages are also undesirable for crime prevention.

Of course, it is possible in principle to attach a so-called dial lock for use in a safe to a door or the like. It is nearly impossible to actually attach the dial lock to the usual door for reason of structural limitations of both the lock and the door, designing conditions, design problems and the like.

A solution to the problem is described, for example, in the applicant's prior invention disclosure, i.e., Japanese Patent Application Laid-open No. 71968/1982 (Japanese Patent Publication No. 54951/1987), Japanese Patent Application Laid-open No. 66055/1994, and the like.

FIGS. 21 and 22 show an example, a so-called tumbler pushing type of button lock 1 in which the lock is fixed to a door surface or the like and a predetermined number of button bodies are pushed in accordance with a keyword indicating a predetermined locking/unlocking combination to operate a cylinder lock and accordingly advance/retreat a dead bolt for locking/unlocking. The button lock 1 comprises a case frame 2 mounted on an outer surface of a door (not shown), a backing plate 4 provided via bridge pipes 3 relative to the case frame 2 on an underside of the door, and a known deadlock 6 having a dead bolt 5.

The deadlock 6 is lockably/unlockably interconnected to a square mandrel 8 which is interposed between a handle 7 of the case frame 2 and a handle 7' of the backing plate 4 for fastening and unfastening the deadlock 6.

A button body, i.e., a plate tumbler 11 shown in FIG. 22, is engaged with each of a set number of cover buttons 10 attached to a cover plate 9 provided on the case frame 2 in a predetermined manner. A middle portion of each tumbler is notched to form a slit notch 12 which can be set in a locked or unlocked condition by means of a key plate (not shown), and upper and lower end portions thereof form hook notches 13 for engaging with a lock spring provided on a reset plate (not shown) to set the tumbler 11 in a pushed condition.

Therefore, in the button lock 1, an operator can selectively set the number indicated on the cover plate 9 corresponding to the arrangement of the buttons stored in accordance with the designated keyword. When the tumbler 11 is initially attached to the door, the tumbler 11 is set in a stored condition (erected condition) or in a non-stored (inverted) condition. If the arrangement of the buttons in the stored condition has to be changed unexpectedly for any reason, then the erected or inverted conditions of the tumblers 11 need to be selectively changed, which requires detaching the case frame 2 from the door and separating a mechanical portion. The operation of switching the erected/inverted condition of each tumbler 11 is very laborious. Moreover, when the erected/inverted condition needs to be changed frequently the tumbler 11 is disadvantageously deformed by wear and stops working.

A solution to this the problem, described in the applicant's prior invention, i.e., Japanese Patent Application Laid-open No. 80074/1983 and shown in FIG. 23, is a button lock having a rotary button.

In this rotary-button lock, as shown in FIG. 23, a button body has a cylindrical head 74 and a block-shaped lower portion with slide notches 13' cut into two opposing sides, so that the lower portion presents a different outline when rotated about its axis by 90°.

At a first angle flat surfaces 15 are seen along a direction running between the upper left and the lower right; this direction is the sliding direction for the plate 26, and FIG. 23 shows the button body rotated to this first angle.

When the button body is rotated to the second angle the upper and lower (or, left and right) slide notches 13' are seen along the sliding direction. The thickness of the slide notches 13' is such that they accept a slide notch 17 formed in a key plate 16; the lengths of the button slide notches 13' are set longer than the width of the slide notch 17. Therefore, in the attitude shown in FIG. 23, the key plate 16 cannot be slid relative to the button to reach a locked condition. On the other hand, when the button is rotated 90° via a minus notch (i.e. slot screwdriver notch) 19 formed in a tip end of a shank of the button body and pushed in via a cover button 10, then the upper slide notch 13' is engaged in the slide notch 17 of the key plate 16. Therefore, the key plate 16 can be slid relative to the button.

Therefore, the handle 7 of FIG. 21 can be turned right or left (directions R or L) to operate the deadlock 6 via the square mandrel 8 and relatively move the dead bolt 5 for locking/unlocking.

Still referring to FIG. 23, when the lower slide notch 13' of the button is opposed to the slide notch 17 of the key plate 16 and the slide notch 17 interferes with shoulder portion 20', a "non-stored" condition is set in which the key plate 16 is not slidable. On the other hand, by turning the button 90° via the screwdriver notch 19 in the tip end of the shank, a "stored" condition is maintained by pushing the button against a spring 21 and engaging a hook spring 24 in a lower reset plate slide notch 23 in an annular spring notch 25 formed in an upper portion of the screwdriver notch 19 of the shank.

In the stored condition, since the upper slide notch 13' is engaged with the slide notch 17 of the key plate 16, the key plate 16 can be slid and the handle 7 can be rotated to unlock the deadlock 6 via the square mandrel 8, so that the dead bolt 5 can be retreated.

In FIG. 23, numeral 26 denotes a presser plate of the key plate 16, 27 denotes a back plate of the pressure plate 26, 28 denotes a snap washer pressed against the key plate 16 via the presser plate 26 and the back plate 27, 29 denotes another back plate, 30 denotes a backing plate, and 31 denotes elastic springs for applying return forces.

A remaining problem is as follows:

In the button lock having the rotary button shown in FIG. 23, the locked condition of the key plate 16 relative to the button is set by the shoulder portion 20' of the slide notch 17. The shoulder portion 20' abuts against the slide notches 13' with a high frequency, causing friction. If the key plate 16 is of zinc, which is the commonly-used metal for such parts, then wear is excessive and the locked condition is not secure. When the locked or unlocked condition is realized by turning the button 90° via the notch screwdriver 19 in the tip end of the shank, the rotation angle is limited to 90°. Once the shoulder portions of the upper and lower slide notches 13' are badly worn, the stored or non-stored condition cannot be realized securely.

The button locks shown in FIGS. 21 and 23 must be adapted for use on the right or left side relative to the door. For this, as shown in FIG. 24, a right-handed operation pin 48 or a left-handed operation pin 48' which abuts on the key plate 16 of a rotary cam 47' cooperating with the handle 7 to slide the key plate 16 is selectively pushed in and engaged for use. The attachment of the button lock to the dead bolt 5 for right-handed or left-handed operation is relatively laborious. Moreover, the maintenance or management of components of the operation pins 48 and 48' is intricate work.

Furthermore, since the handle 7 is fixed on the outer case frame 2 of the door with just a bolt, the handle 7 can be taken away by removing the bolt through intentional mischievous action. Such mischief frequently occurs, and the button lock cannot perform its function.

SUMMARY OF THE INVENTION

Accordingly, the present invention has an object, among others, to overcome deficiencies in the prior art such as noted above.

An object of the present invention is to solve the technical products of the prior-art button lock and to the provide a superior button lock useful in a technical field of lock operation in the building industry which a button of a key plate can be slid freely relative to a button shank when either the stored condition or the non-stored condition is set by pushing the rotary button, there is no wear on the button or key-plate slide notches even when the button locked or unlocked condition is selectively realized, the function of the button lock can be usually maintained with a good durability, the right-handed or left-handed operation facility can be selectively offered not only the initial attachment to the door but also during the operation, the extraction of a bolt or another crime can be prevented, intrinsic merits of the button lock can be fully used to assure smooth operability.

To attain the aforementioned object and solve the aforementioned problems, in a constitution of the present invention a button lock is provided with multiple button bodies covered with cover buttons, said button bodies being exposed on a cover plate of a case frame on a surface of an outer door, set optionally in an arrangement of a stored or non-stored condition in accordance with a keyword for locking or unlocking a dead bolt of a deadlock and disengageably engaged with a key plate which can slide in the case frame, a handle cooperating with the key plate being engaged via a square mandrel with said deadlock. Said button body is formed in a bar shape and integrally has upper and lower stopper flanges, a predetermined number of slit notches of the same configuration and the same size in which the button bodies are releasably inserted are formed in predetermined positions in the key plate which is slidably provided in said case frame. Each button body loosely inserted in the slit notch of the key plate can advance or retreat orthogonally with the case frame. A slot screwdriver notch is formed in a tip end of the button body in such a manner that said stopper flanges permit a selective attitude of the button body in a position in which in one turned attitude the button body intersects the key plate to inhibit the key plate from advancing or retreating while in another turned attitude the key plate is permitted to advance or retreat. Each button body can be releasably engaged with a reset plate to realize a locked condition. The handle cooperating with said deadlock can be engaged via a rotary cam with the key plate and the reset plate. A fixing screw is provided for selectively fixing the handle relative to a rotation shaft of the rotary cam for righthanded or left-handed operation, and a lock clear button for unlocking the key plate is provided on the cover plate of said case frame. In the basis constitution, a hook notch is formed in said key plate and can be engaged with the stopper flange of said button body. The hook notch is formed in an angle shape. The key plate is slidably interposed between the button presser plate and the button reset plate. The button reset plate is provided with a lock spring for a hook slit of the button body. The clear button has a cam face formed thereon which can release locking of each button body in the button reset plate. An elastic spring is interposed along the button body between said key plate and the button reset plate. The rotation shaft is provided with a snap washer for preventing the handle from being extracted. A washer for fixing the handle is interposed between said snap washer and the rotation shaft. The rotation shaft is attached via a screw bolt to a base of the handle. A left or right side of the screwdriver notch of said button body is colored and classified; and a button washer is attached via a spring to said key plate and the button presser plate.

First, when the button lock of the present invention is attached to the door or when the attachment position is changed in the midst of the operation to attach the handle to the case frame of the button lock for the right-handed or left-handed operation, the base of the handle is selectively fixed to the rotation shaft of the rotary cam via a square-spanner screw. In this manner, the handle is fixed with the rotation shaft via the washer for preventing the handle from being extracted. Subsequently, the snap washer is interposed between the handle fixing washer and the rotary cam in such a manner that the handle is firmly prevented from being extracted but the handle can be freely rotated. The screw is fastened and fixed in a right-handed or left-handed operation position by using a square spanner on a boss portion of the handle from the side, so that the handle cannot be removed from the case frame. When the handle is turned in a desired direction, the rotary cam fixed to the rotation shaft of the handle slides the key plate mounted in the case frame. The bar-shaped button body with the return spring attached thereto is pushed in by pushing the cover button attached to the button presser plate against the return spring, and the upper and lower stopper flanges of the button body are engaged with the hook notch provided on the key plate to slide.

In this stored condition, the stopper flanges slide along the hook notches of the key plate. In the non-stored condition, the stopper flanges of the button body can freely slide in such a manner that the stopper flanges are not engaged with the hook notches of the key plate.

The stored condition or the non-stored condition is selected by turning the screwdriver notch 180° which is formed on the tip end of the shank of the button body and colored or otherwise to be classified. Thereby, the stopper flange is engaged with the angle portion or another portion of the hook notch of the key plate and the predetermined hook notch of the button presser plate. The locked condition is maintained by operating the handle, the key plate does not slide, and the button body cannot be unlocked. By pushing the button body against the return spring, the other stopper flange is engaged with the slide notch of the key plate and allowed to slide. By engaging the stopper flange of the button body in the stored condition with the slide notch of the key plate beforehand, all the key plates can be slid. When the handle is rotated, the deadlock can be unlocked via the square mandrel and the dead bolt retreats to realize unlocking. When aforementioned locking and unlocking are repeated, a zinc pin or other components are engaged with the upper and lower stopper flanges formed on the shank of the button body and the angle or another shaped hook notches on the key plate and the button presser plate. In this case, the components are not worn, and excellent durability is provided. The right or left side of the screwdriver notch in the tip end of the shank of the button body 54 is classified with color. By rotating the screwdriver notch 180°, the stored or non-stored condition is selected. The stopper flange of the button body is engaged with the hook notch of the key plate with a phase difference of 180°, thereby avoiding wear. Locked or unlocked condition of the key plate is maintained-with excellent durability. By rotating the screw threaded on the base of the handle with the square spanner to rotate the handle relative to the rotation shaft, the right-handed or left-handed operation can be optionally selected. The facility of operation is enhanced, crimes are effectively prevented, and safety and durability are thus enhanced.

Additionally, the button washers are attached via the springs to the button holes in the button presser plate and the key plate. Since the button washers are engaged in the lock notches formed beside the slide notches in the key plate, the keyword of the button body of the stored condition cannot be searched by trying to slide the key plate little by little while turning the handle. Specifically, the key plate is prevented from being slid and the keyword of the stored button body cannot be searched. The durability and crime preventive properties of the buttons are enhanced, and the handle is prevented from being extracted.

BRIEF DESCRIPTION OF THE DRAWING

The above and other objects and the nature and advantages of the present invention will become more apparent from the following detailed description of embodiments taken in conjunction with drawings, wherein:

FIG. 25(*a*) is a similar view but showing the button body in a different position, analogous to a rotated button body.

DETAILED DESCRIPTION OF THE PREFERRED EMBODIMENT

In FIGS. 1 to 20 and 25, showing a preferred embodiment of the present invention, the same numerals are used as for corresponding parts in FIGS. 21–24.

Figure 2:
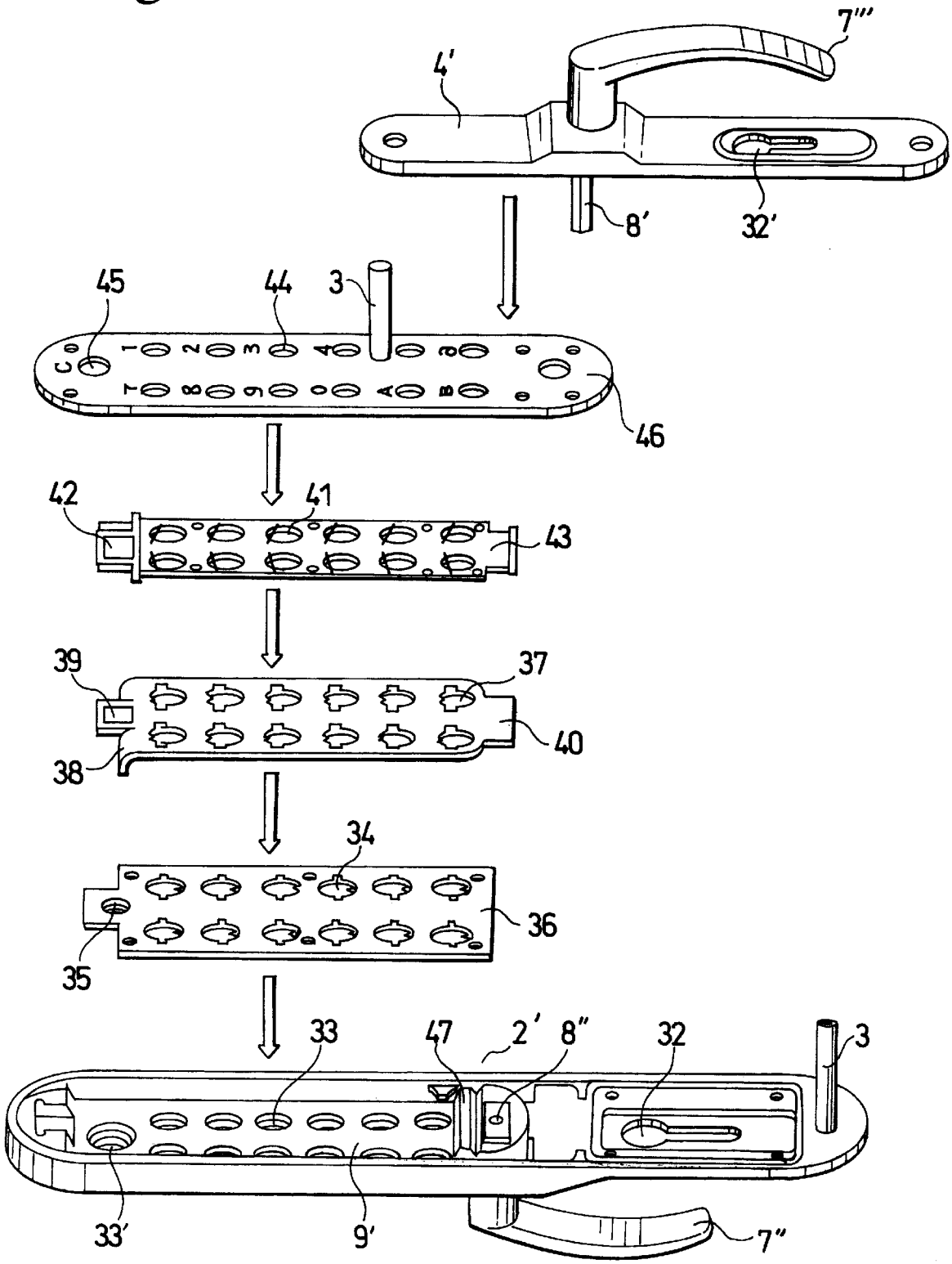
FIG. 2 is another perspective view showing laminated mechanical portions exploded from a case frame.
Figure 25B:
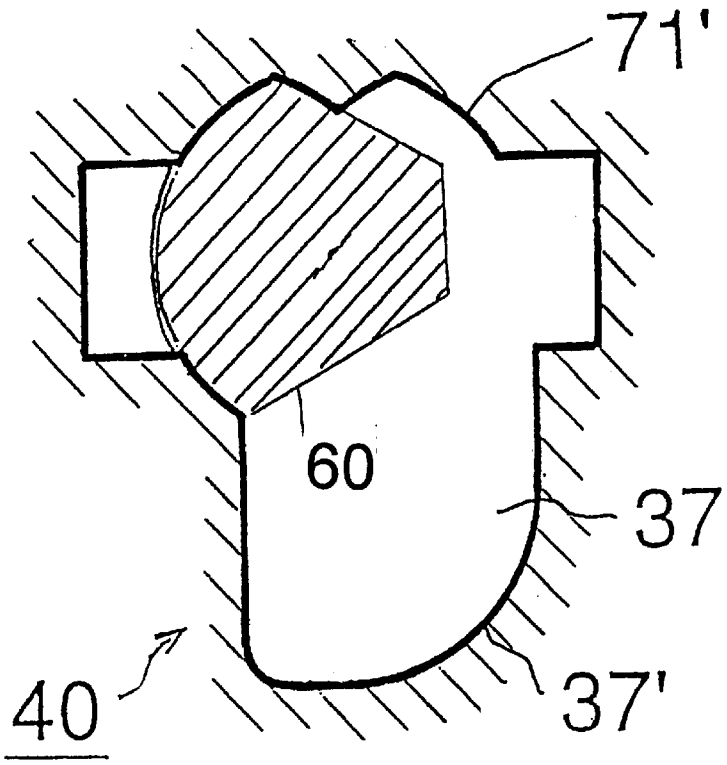
FIG. 25(*b*) is a cross-sectional view on lines XXV—XXV of FIG. 7.
Figure 25A:
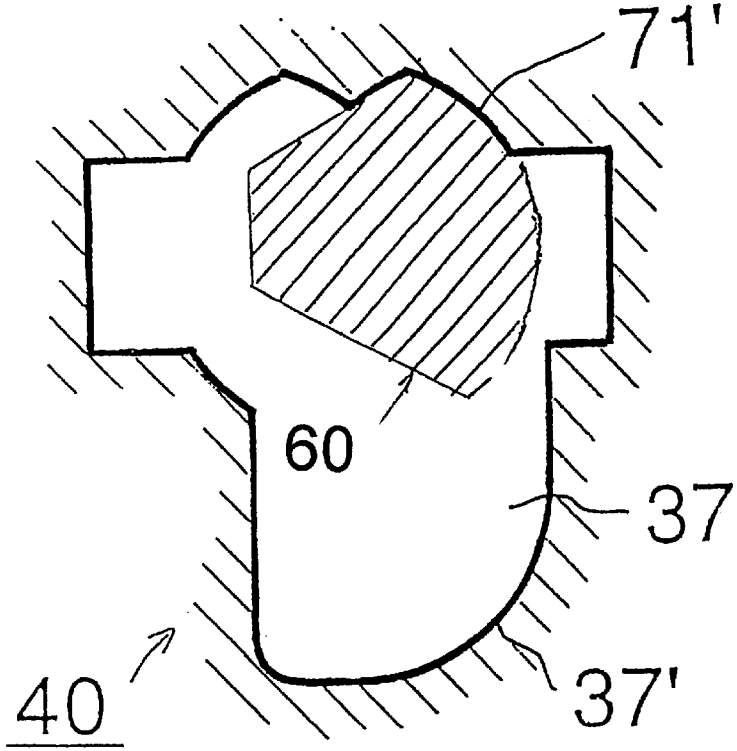

FIGS. 25(*a*) and 25(*b*) are cross-sections of the key plate 40, shown in FIG. 2 as one element of a "sandwich" of sliding elements also including a reset plate 43 and a presser plate 36 (FIG. 2). Both FIGS. 25(*a*) and 25(*b*) are taken on a plane parallel to the surface of key plate 40, and each shows one of the slide notches 37 of the key plate 40.

Figure 5:
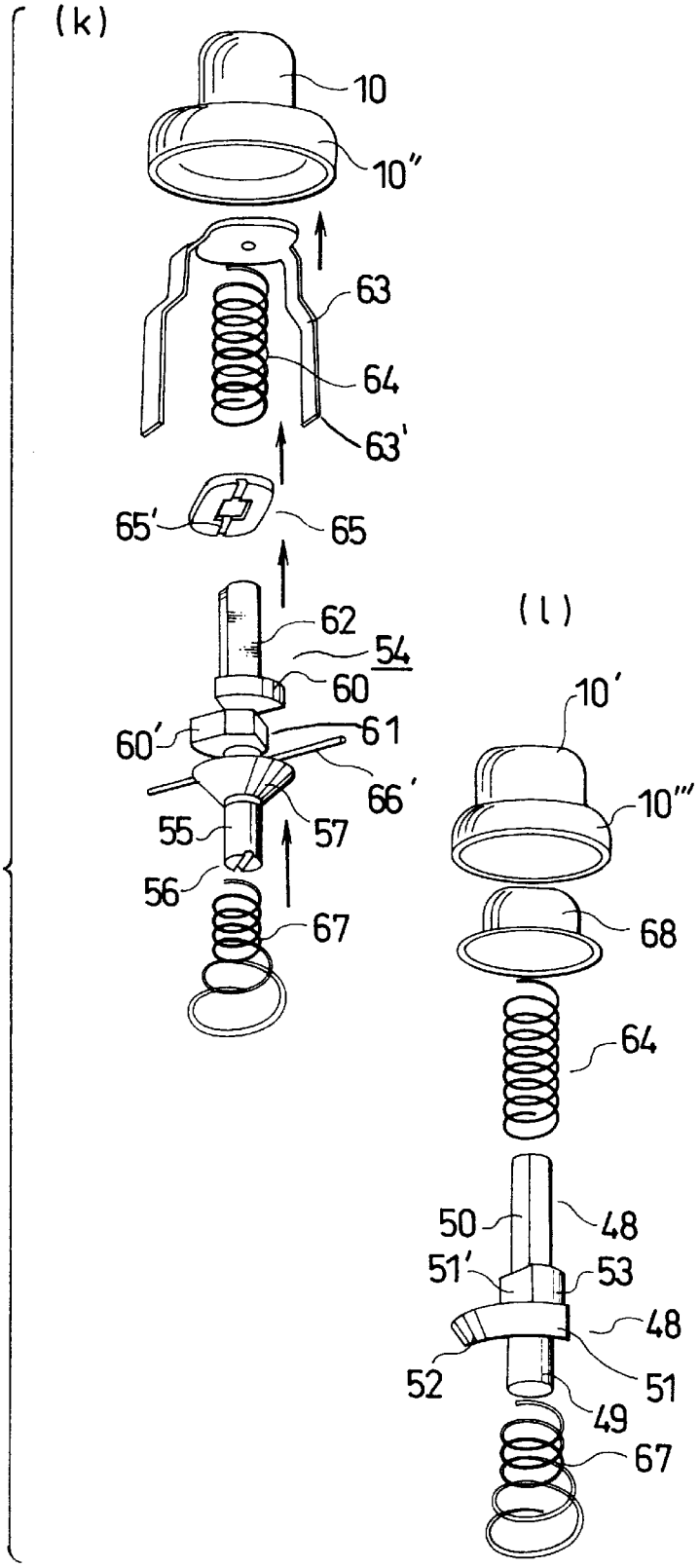
FIG. 5(*k*) is an exploded perspective view of a cover button and the button body and FIG. 5(*l*) is an exploded perspective view of the cover button and the clear button.

Inside each of the slide notches 37 is a stopper flange 60 or 60' ; these are adjacent portions of the button body 54, as is best seen in FIG. 5(*k*). The stopper flanges 60 and 60' are located at different distances along the axial length of the button body 54 and their sections are congruent, but rotated 180° relative to one another.

Certain of the button bodies 54 are selectively pressed down for unlocking; which of the stopper flanges, 60 or 60', ends up inside the slide notch 37 depends on whether that button has been pushed by the person using the lock. The mechanism unlocks by permitting the key plate 40 to slide under the force of the rotary cam 47 which rotates with the handles 7" and 7'" (FIG. 2). Selective pushing of a particular set of buttons allows the key plate 40 to slide and release the unlocking device.

In FIG. 25(*a*) the button has been depressed and a stopper flange 60 is lined up with the key plate 40. Turning momentarily to FIG. 5(*k*), it is seen that the stopper flange 60 is disposed above stopper flange 60', i.e. it is closer to the cover button 10 which is pushed by the user than is stopper flange 60'. Conversely, the button of FIG. 25(*b*) has not been depressed and it occupies the elevational position shown in FIG. 7.

Figure 7:
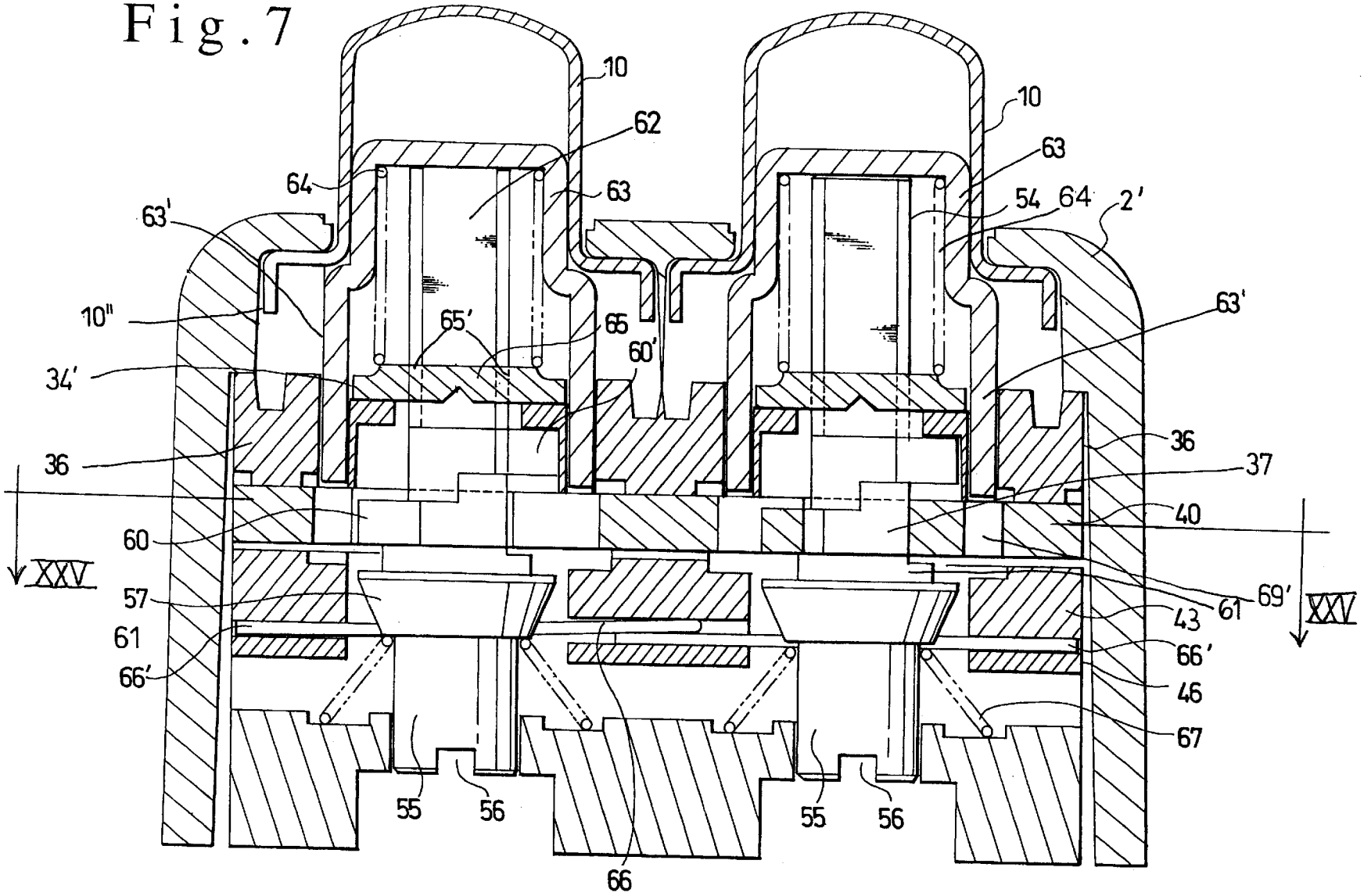
FIG. 7 is a sectional view showing a stored or non-stored condition of the button body relative to a key plate.
Figure 16:
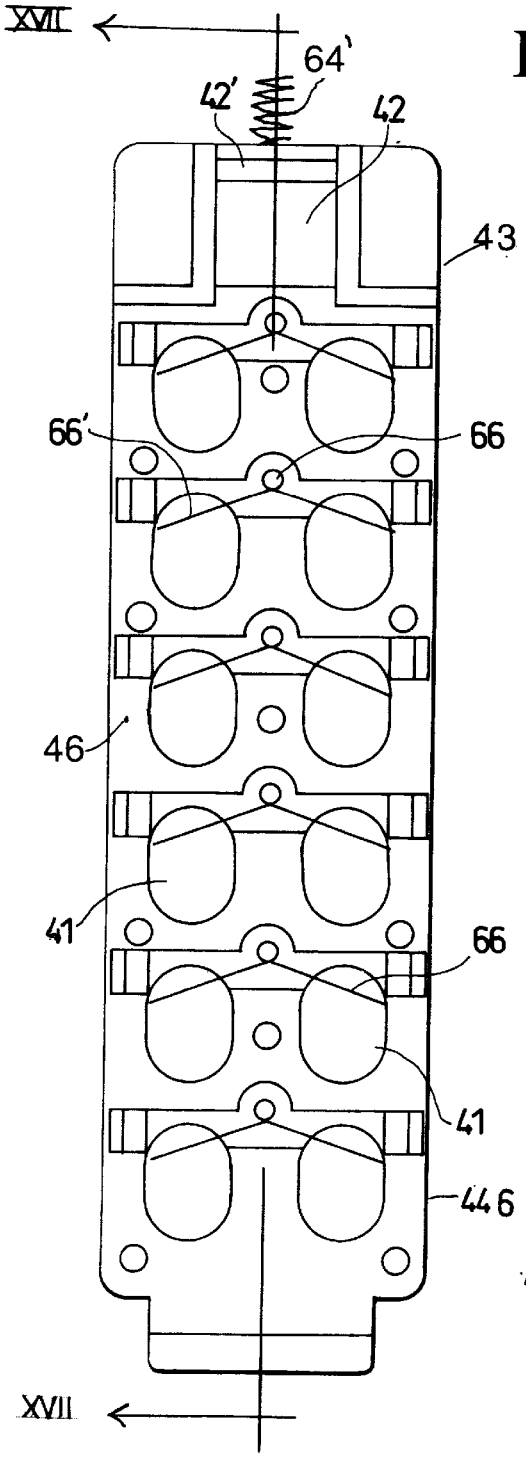
FIG. 16 is a plan view of the reset base plate.

It is plain from FIG. 7 that when the cover button 10 when pushed moves the button body 54 down. FIG. 7 also shows how the button bodies 54 are locked in the depressed position. When the button bodies 54 are depressed to the point where the cover button 10 seats, the bent-wire lock spring 66' (the overall shape of which is best shown in FIG. 16) will have passed over the upper edge of the tapered lock flange 57. The lock spring 66' will snap over the top of the tapered lock flange 57, preferably into an annular lock spring notch 61, and the button body 54 will then be held in a lowered or depressed position; this position is not shown by FIG. 7 but it is shown in FIG. 25(*b*).

The asymmetrical shape of the slide notch 37, with the bottom portion 37' of the slide notch 37 being offset to the right, is such that the key plate 40 can slide upwardly in FIG. 25(*a*) but not in FIG. 25(*b*). When the button body 54 is depressed the upper stopper flange 60 is positioned inside the slide notch 37 with the upper edge of the upper stopper flange 60 aligned with the top of the key plate 40 (FIG. 7). The key plate is able to slide.

Thus, for the key plate 40 to slide and the lock to release, the button body 54 must be in the position shown in FIG. 25(*a*), i.e. that button must have been pushed by the user.

It might be thought that every button must then be pushed in to release the lock 1'. However, each of the button bodies can be turned 180° using the screwdriver slots 56, best seen in FIG. 4(*g*), which are accessible at the back plate 46.

Any button body 54 can be rotated so that positions of the stopper flanges 60 and 60' are reversed; this reversed position is referred to as "un-stored" or "non-stored". Considering FIG. 25(*b*), it is to be noted that if it were to show stopper flange 60 instead of stopper flange 60', then FIG. 25(*b*) would illustrate the un-stored position with the button body 54 not pushed in, instead of the stored position with the button pushed in.

It will be apparent that if any of the button bodies 54 are in the un-stored position, then the key plate 40 will be unable to slide if those buttons are pushed. However, if they are not pushed then the key plate 40 may slide and the lock can release because the stopper flange 60' is already on the right side (just as stopper flange 60 is on the right side in FIG. 25(*a*)).

Therefore, the lock 1' can release if and only if each button body in the stored position is pushed in and every button body in the non-stored position is not pushed in. Because no one can tell which buttons are stored and which are not stored, the user must know the combination to open the lock 1'.

Figure 9:
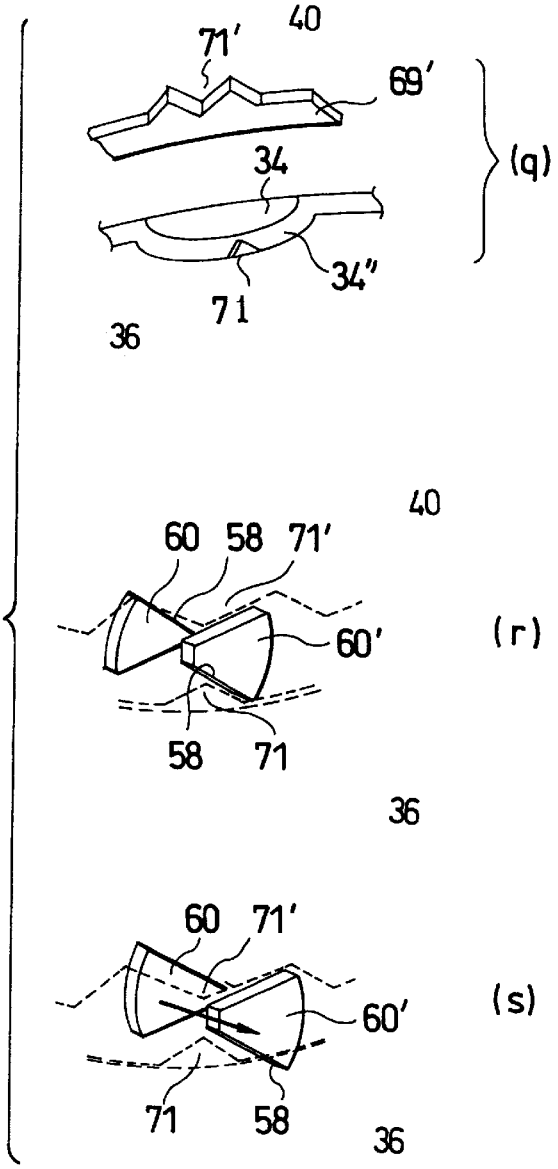
FIGS. 9(*q*)–9(*s*) are perspective views of the button body showing the lock function, wherein: (*q*) is a perspective view of a hook notch of the key plate and a hook notch of a button presser plate to be engaged with each other; (*r*) is a perspective view of the hook notches and two stopper flanges of the button body in the non pushed-in condition; and (*s*) is a perspective view showing the engagement in the pushed-in condition.
Figure 10:
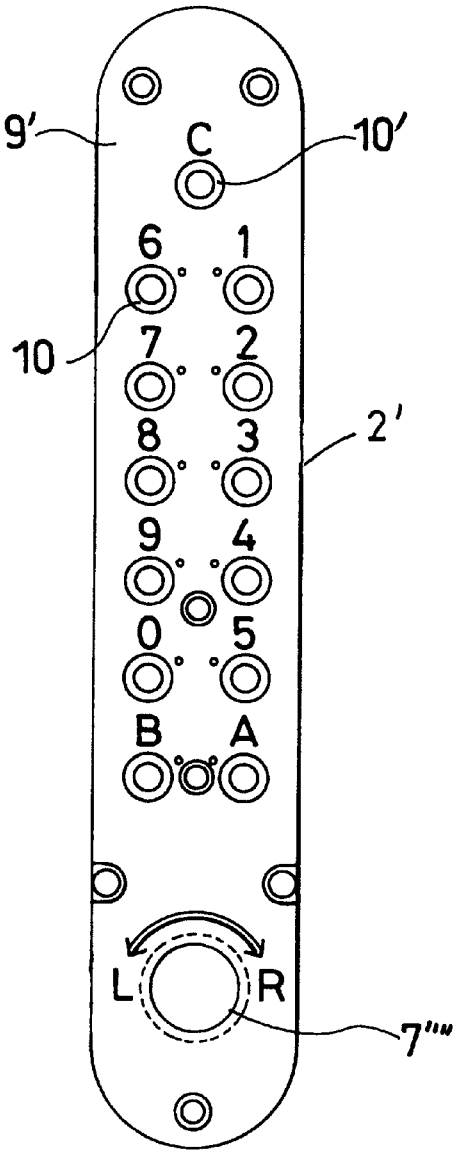
FIG. 10 is a front plan view of a cover plate.
Figure 11:
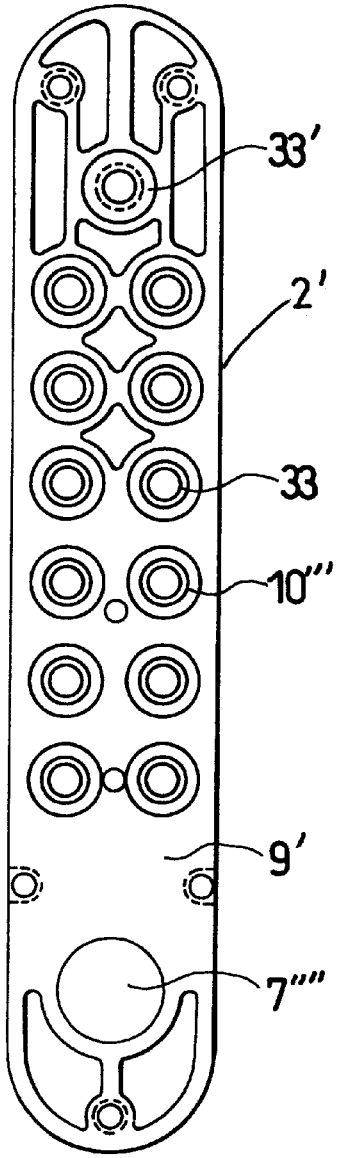
FIG. 11 is a rear plan view of the cover plate of FIG. 10.
Figure 13:
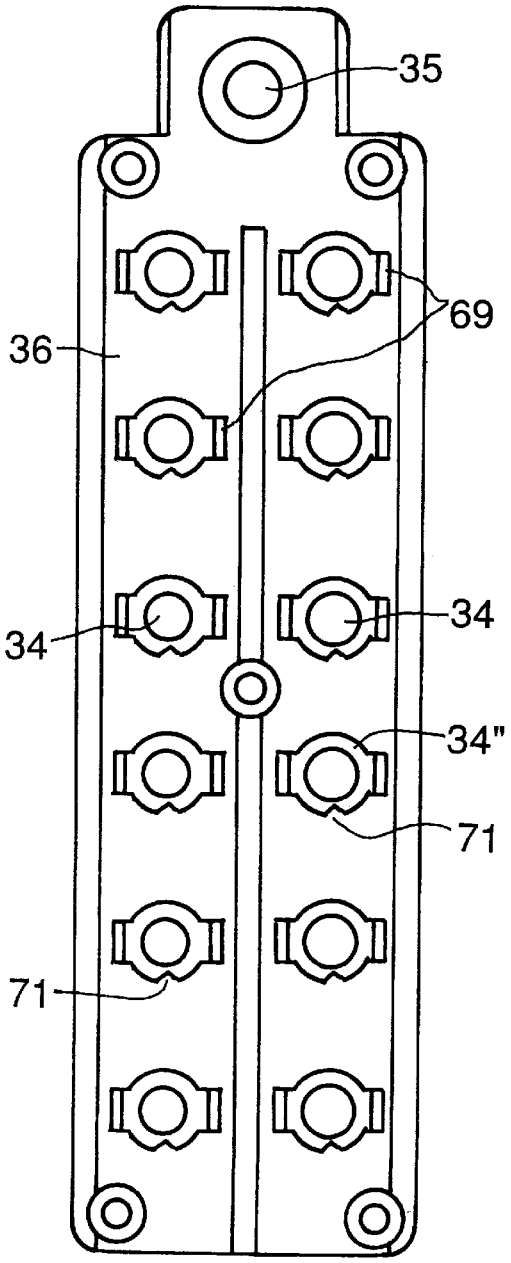
FIG. 13 is a rear plan view of the button presser of FIG. 12.

FIG. 13 illustrates the presser plate 36, also seen in FIG. 2. The button bodies 54 pass through button holes 34 which include angle protrusions 71. Like the angle protrusions 71' of the key plate 40, these engage the sides of the stopper flanges 60 and 60', as shown in FIG. 9. This prevents excessive rotation of the button bodies, as is discussed in more detail below.

Figure 21:
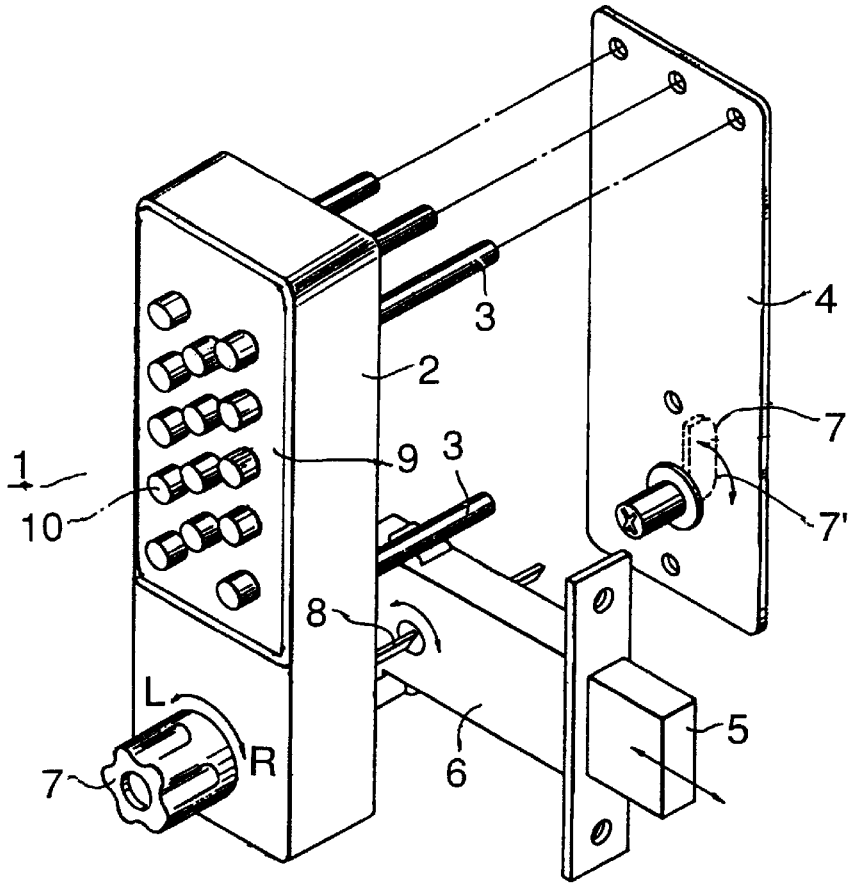
FIG. 21, labeled "prior art", is an exploded perspective view of a prior-art button lock.
Figure 22:
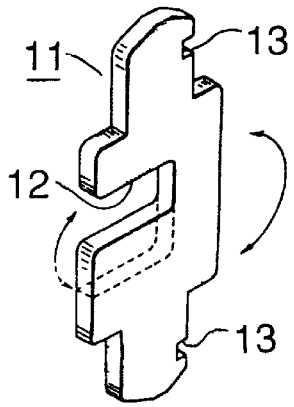
FIG. 22, labeled "prior art", is a perspective view of a tumblers as a button body.
Figure 23:
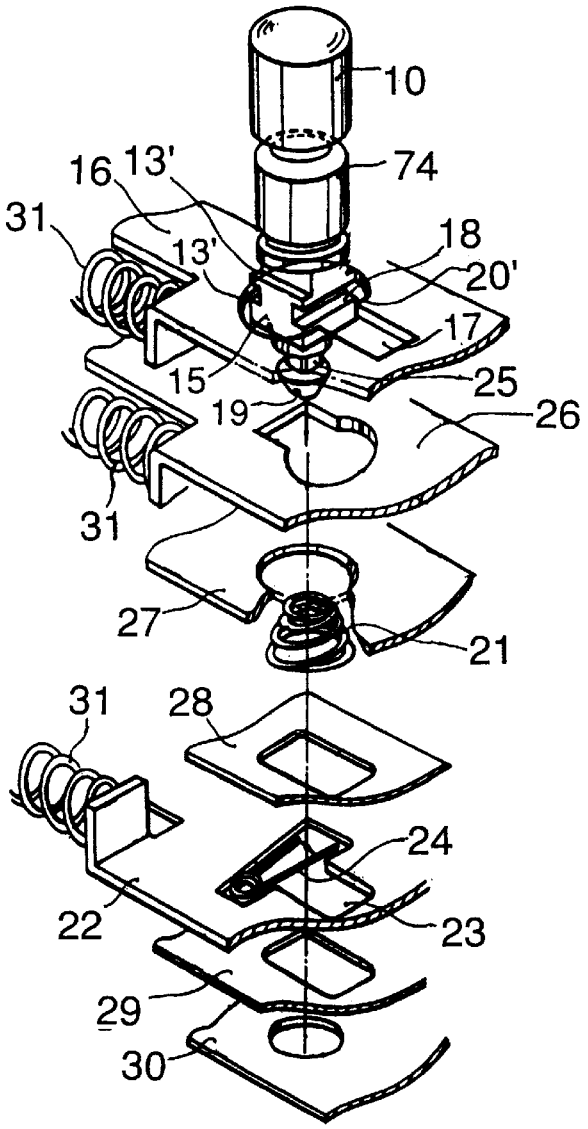
Fig 23 PRIOR ART
FIG 23, labeled "prior art", is an exploded perspective view showing a prior-art button lock.
Figure 24:
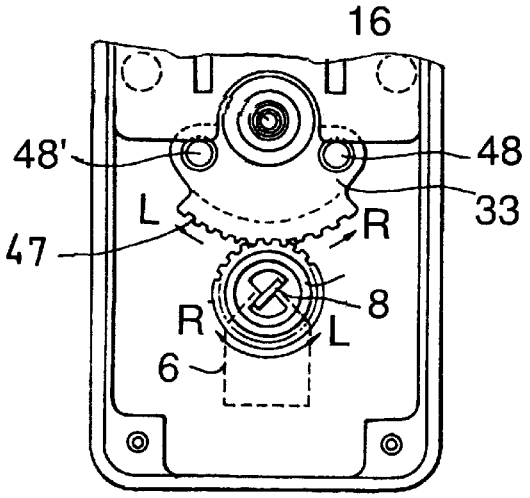
Fig. 24 PRIOR ART
FIG. 24 labeled "prior art", is a plan view of a right-handed or left-handed operation switching mechanism.

FIG. 21 shows the environment of the present invention. The lock is mounted on a door which is rotated or opened in double-hinged manner. In the prior art lock of FIG. 21, numeral 1 denotes a button lock within the scope of the present invention in which the dead bolt 5 of the deadlock 6, embedded in a predetermined position of the double-hinged type door (not shown), is advanced or retreated for fastening/unfastening. The lock of the present invention works in the environment shown in FIG. 21.

Figure 1:
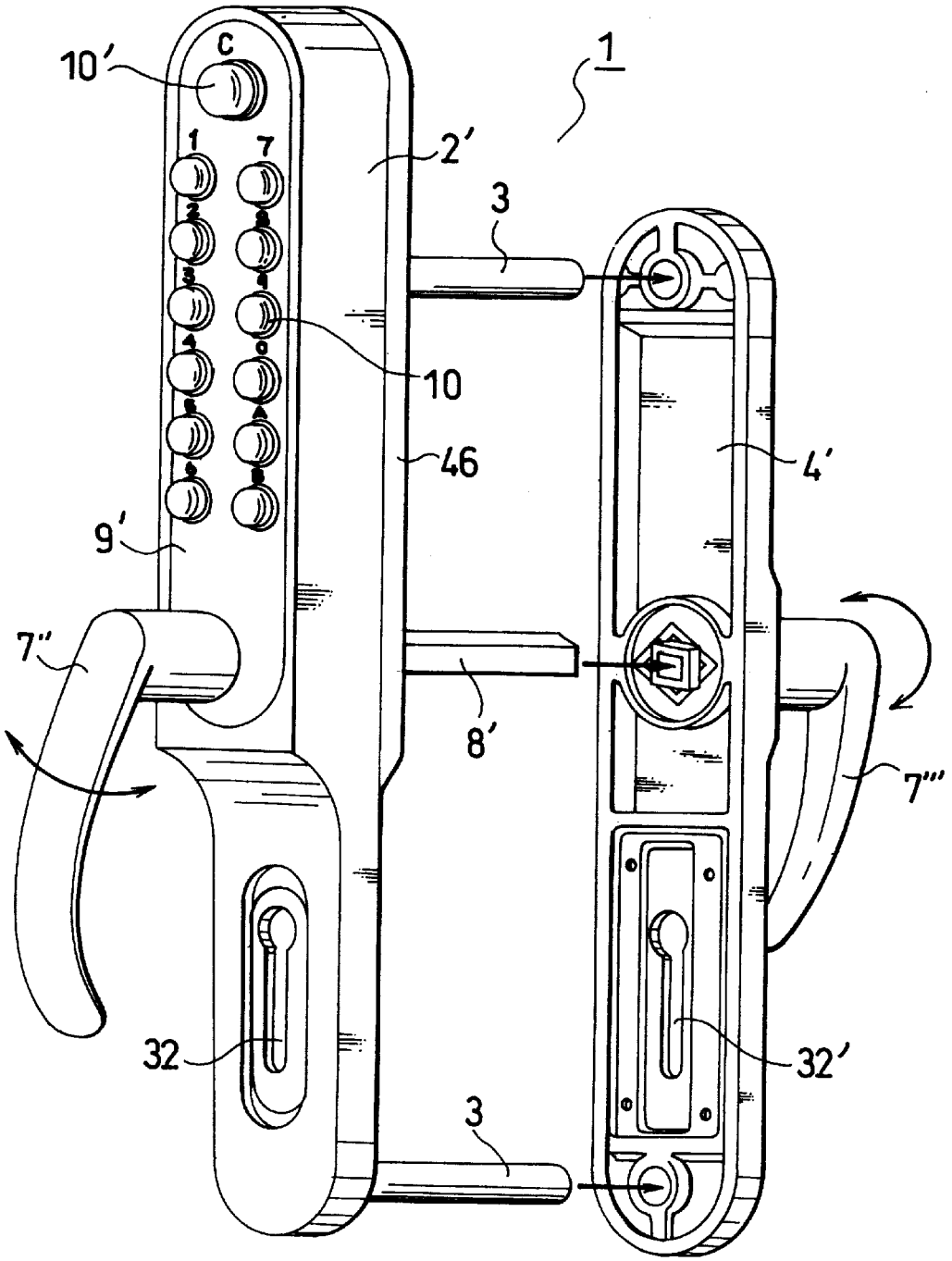
FIG. 1 is an exploded perspective view schematically showing an entire embodiment of the present invention as mountable on the sides of a door.

FIG. 1 shows that the button lock 1' of the present invention comprises a case frame 2' of a mechanical portion which is mounted on the outer surface of the door (not shown) and a sub backing plate 4' interconnected via bridge pipes 3 to the case frame 2' of the mechanical portion on the underside (opposite side) of the door. A lever handle 7" acts as a handle for locking or unlocking the deadlock 6 on the surface case frame 2' and a lever handle 7'" is opposite to the lever handle 711 on the rear sub backing plate 4'. These parts of the unlocking device are operated via a square mandrel 8' which is passed through the deadlock 6.

As shown in FIG. 2, in the case frame 2' forming the mechanical portion mounted on the surface of the door, on the side of the lever handle 7", is a cover plate 9' having holes 33 in which cover buttons 10 are set and on which numerals from 1 to 0 and characters A, B are indicated and hole 33' for the clear button.

Following the cover plate 9' is a presser plate 36 (also shown in FIG. 12) which has twelve button holes 34 for passing the button bodies and a button hole 35 in the top for passing a clear button.

Next, shown above the presser plate 36 in the figure, is a key plate 40 in which twelve slide notches 37 (which also act as button holes, as described later) are formed. The slide notches 37 are to be aligned with the button holes 34 when the key plate 40 is laminated onto (i.e. laid over) the presser plate 36. Flanges 38 for receiving return springs, to be described later, are formed in both sides of the top of the key plate 40 and a clear button hole 39, to be aligned with the clear button hole 35, is formed between the receiving flanges 38.

Next, a reset plate 43 is laminated above the key plate 40. In the reset plate 43 includes two parts (not shown in FIG. 1; see FIGS. 16–18), fixedly overlapped with one another and a cam frame 42 for the clear button on the end of reset plate 43. Twelve slit notches 41 are formed in the reset plate 43 to be aligned with the slide notches 37 of the key plate 40 and button bodies 54 are passed through. The reset plate is slid by a predetermined span, and the button bodies 54 (described later) are passed through the slide notches 37, slit notches 41, and button holes 34.

Also fitting in the case frame 2' is a back plate 46 fixed with screws (not shown) or the like into a laminated condition and bearing a character "C" beside a clear button hole 45 and numerals "1" to "0" and characters "A" and "B" are indicated beside button-body holes 44 in the back plate 46 to clearly show a keyword.

The sub backing plate 4' is integrally connected via a bridge pipe 3 to the back plate 46 on the underside (i.e. back side) of the door.

Key notches 32 and 32' are formed adjacent ends of the lever handle 7" of the case frame 2' and the lever handle 7'" of the sub backing plate 4' for passing through a master key for use when unexpected trouble occurs.

Each of the mechanical portions set in plural layers in the case frame 2' will now be described in detail.

Figure 3:
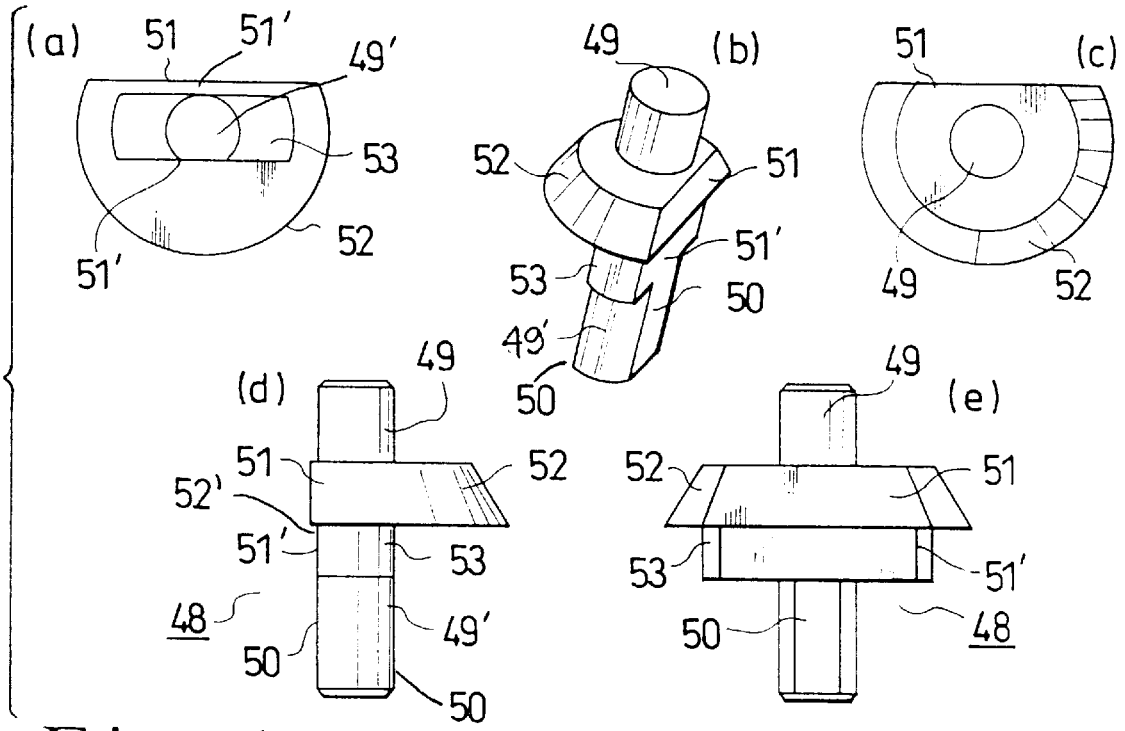
FIGS. 3(*a*)–3(*e*) are plan, elevational, and perspective views showing a clear button wherein: (*a*) is a top view thereof; (*b*) is a perspective view thereof; (*c*) is a bottom view thereof; (*d*) is a side view thereof; and (*e*) is a rear view thereof.

FIG. 3 shows a clear button 48. In FIG. 3 the cover button 10' shown in FIG. 5(L) is on the underside. A shank 49 having a predetermined size and a short cylindrical cross section with a predetermined diameter is formed on the side engaging of the backplate 46, a flat surface 51 is formed on an inferior arc below the shank 49, and a cam flange 52 having a face tapered toward the cover button 10' is formed on a superior arc. A sub flange 53, formed on the under surface of the cam flange 52, is wider than the adjacent shank 49. It has a circular cross section and flat surfaces 51' on both sides thereof. A shank 49' with a predetermined length extending from the sub flange 53 has flat surfaces 50 formed on both sides thereof. The shank 49' shares the flat surface 51' with the sub flange 53; their portions of the surface 51' are coplanar as shown in FIGS. 3(*b*) and (*d*).

The flat surface 51 on the inferior arc of the cam flange 52 is formed with a slight step 52' from the flat surfaces 51' of the shank and the sub flange 53; this configuration, shown in FIGS. 3(*a*) to (*e*), is provided to reduce interference for smooth sliding of the reset plate 43 over a predetermined span and to allow an empty lock to operate.

Figure 17:
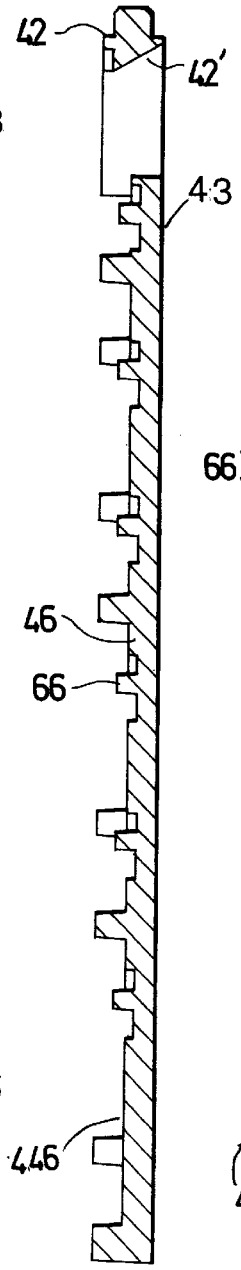
FIG. 17 is a vertical sectional view of a center of the reset base plate.

FIG. 17 shows a cam face 42' shaped inside cam frame 42. The tapered face of the cam flange 52 of clear button 48 performs a cam action on the cam face 42' formed on the square cam frame 42 shaped at the end of the reset plate 43, and slides over a predetermined span along with the reset plate 43.

Figure 4:
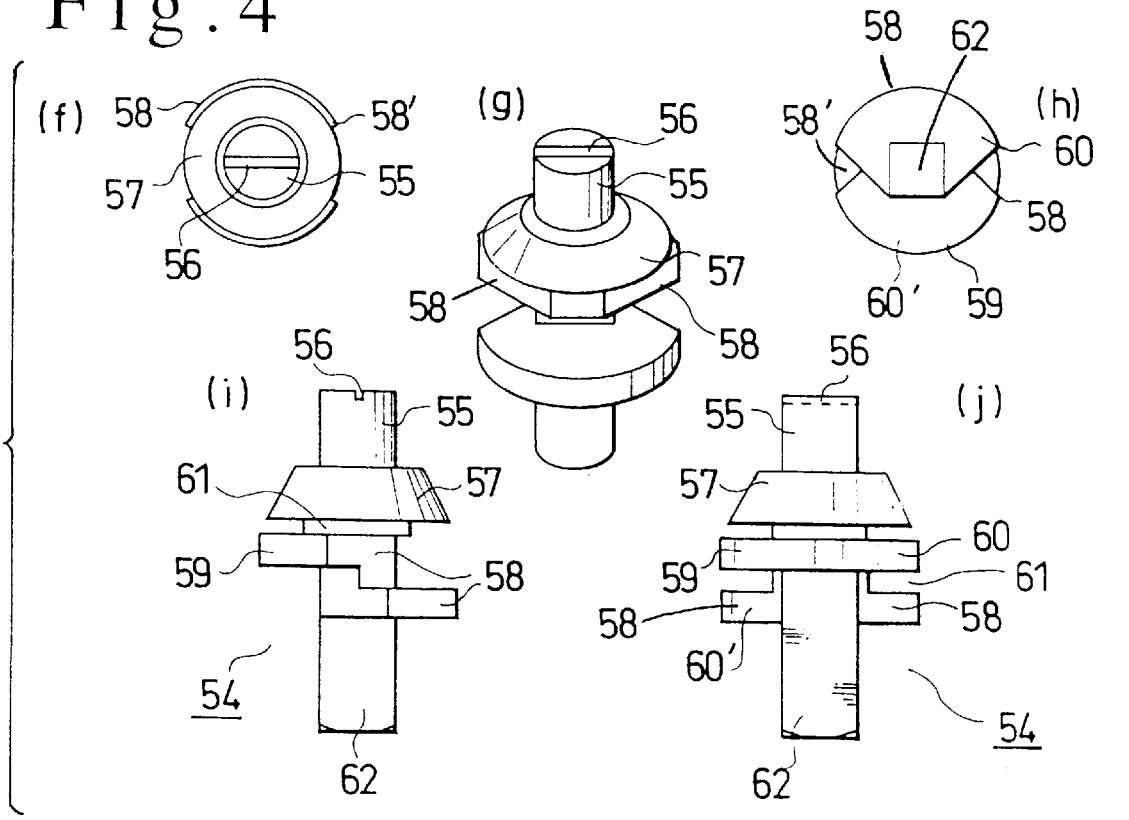
FIGS. 4(*f*)–4(*j*) are plan, elevational, and perspective views showing the appearance of a button body wherein: (*f*) is a top view thereof; (*g*) is a perspective view thereof; (*h*) is a bottom view thereof; (*i*) is a side view seen from one direction; and (*j*) is another side view seen from the other direction.

FIG. 4 shows one of the bar-shaped button bodies 54. Also shown in FIG. 4 is a shank 55' which is intended to engage the cover button 10, and a shank 55 intended to engage button holes 44 of back plate 46.

The top of the shank 55 of button body has a cylindrical cross section for fitting the button hole 44 (shown in FIG. 2) in the back plate 46. The top is provided with a screwdriver notch 56 (formed or slotted) for rotating the button body 54 with a screwdriver or the like into either a "stored" or a "non-stored" condition; this sets the keyword which operates the lock.

An annular, tapered lock flange 57, expanding toward the cover button 10, is integrally formed on the lower portion of the shank 55, and a circular groove or annular lock spring notch 61 is formed adjacent to the tapered lock flange 57 for holding the button body 54 in the stored condition once it has been pushed into the stored condition in accordance with the keyword. The button body is held because the lock spring 66' snaps into the annular lock spring notch 61; FIG. 7 shows the lock spring 66' at the smaller end of the tapered lock flange 57 prior to the button having been pushed.

Figure 18:
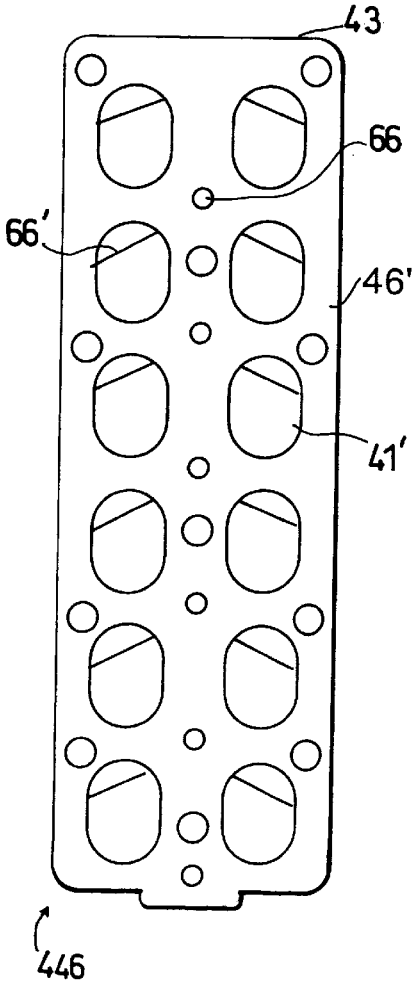
FIG. 18 is a plan view of a reset plate presser plate.

FIGS. 16 and 18 show the arrangement of the lock springs 66' (also visible in FIG. 2, though not numbered there), which have torsional portions wrapped around stopper pins 66. They obliquely traverse slit notches 41 (FIG. 16) and 41' (FIG. 18) in two parts of the reset plate 43, which as seen in FIGS. 16–18 includes a base plate 446 (FIGS. 16 and 17) and a reset plate presser plate 446' (FIG. 18). The torsion springs 66' traverse these plates, via stopper pins 66, between the base plate 446 of the reset plate 43 and the reset plate presser plate 446' of the reset plate 43 which is closely set on the base plate 446.

FIG. 4 shows in detail the slit or lock spring notch 61 or button body 54, which is engaged with each torsion spring 66' transversely extended across the stopper pin 66. Two stopper flanges 60 and 60' are disposed below the slit or annular lock spring notch 61, at different positions along the axis, on the side forward the cover button 10. They are, preferably, integrally formed on a shank 62 with a square cross section which has a diagonal length equal to the diameter of the shank 55.

The stopper flanges 60 and 60' each has a superior arc (i.e. partial-cylindrical) face 59. Each superior arc is centered relative to the line of the screwdriver notch 56. Each has two flat faces 58 extending inward from the ends of each superior arc face 59, so that the stopper flanges are generally fan-shaped. Their arcs face symmetrically away from each other as shown in FIGS. 4(*f*) and 4(*h*) and they are offset in the axial direction, as shown in FIGS. 4(*i*) and 4(*j*).

Preferably, the flat faces 58 of each superior arc 59 are angled at 45° to the axis of the screwdriver slot as illustrated. Also preferably, as shown in FIG. 4(*h*), the flat faces meet the corners of the square-section shank 62, meaning that the superior arcs 59 subtend more than 90°.

As shown in FIG. 13 the button presser plate 36 includes angle protrusions 71 formed midway in a depth direction of the button holes 34 of the button presser plate 36. These angle protrusions 71 engage obtuse-angle shoulder portions 58' of the button bodies 54, shown in FIG. 4.

Figure 14:
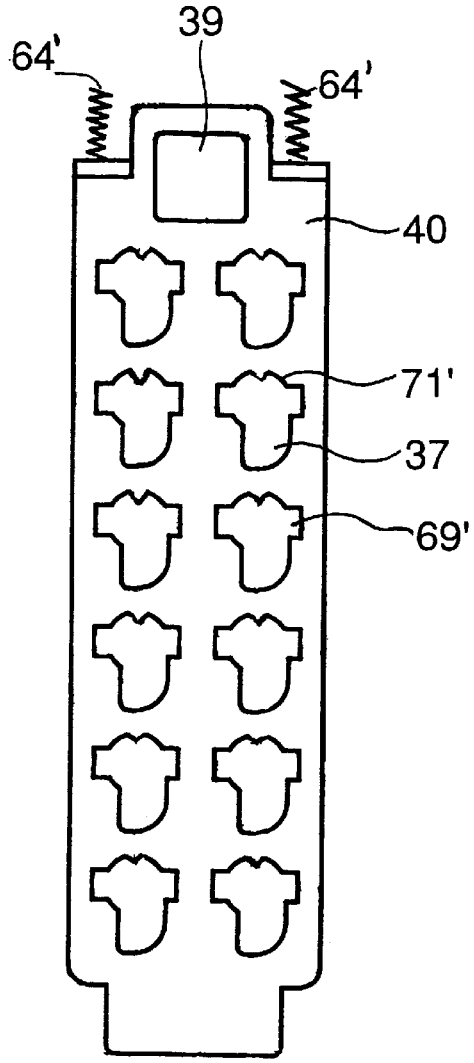
FIG. 14 is a front view of the key plate.
Figure 15:
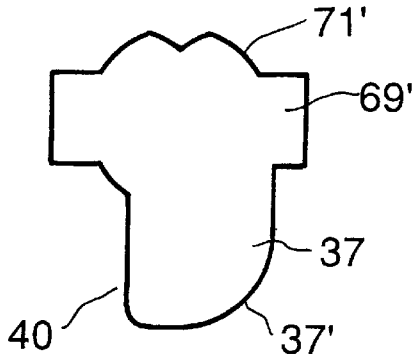
FIG. 15 is an enlarged front view of the slide notch in the key plate.

Likewise in the key plate 40, shown in FIGS. 14 and 15, angle protrusions 71' are formed on end faces of the slide notch or button-passing holes 37 (best seen in FIG. 15). The obtuse-angle shoulder portions 58' of button bodies 54 are pushed from the upper, lower, front and rear faces of the button presser plate 36 and the key plate 40. Because of this structure, unexpected excess rotation is prevented and the button bodies 54 are prevented from being excessively damaged by the button presser plate 36 (which is preferably of zinc) and the key plate 40.

The shank 62 of button bodies 54 has a square cross section extended integrally from the upper and lower stopper flanges 60 and 60' toward the cover button 10. The width of the shank surface is vertically adapted to the size of the slide notch 37 of the key plate 40 to allow relative sliding of the shank and the notch. FIG. 15 shows that the slide notch 37 includes a bottom 37' formed into a configuration which is adapted to the superior arc face 59 of the button body 54, in such a manner that when the button body 54 is rotated to the stored condition by the screwdriver notch 56, the superior arc of the upper stopper flange 60 of the pushed-in button body 54 slides and then stops as shown in FIG. 8(*n*).

Figure 8:
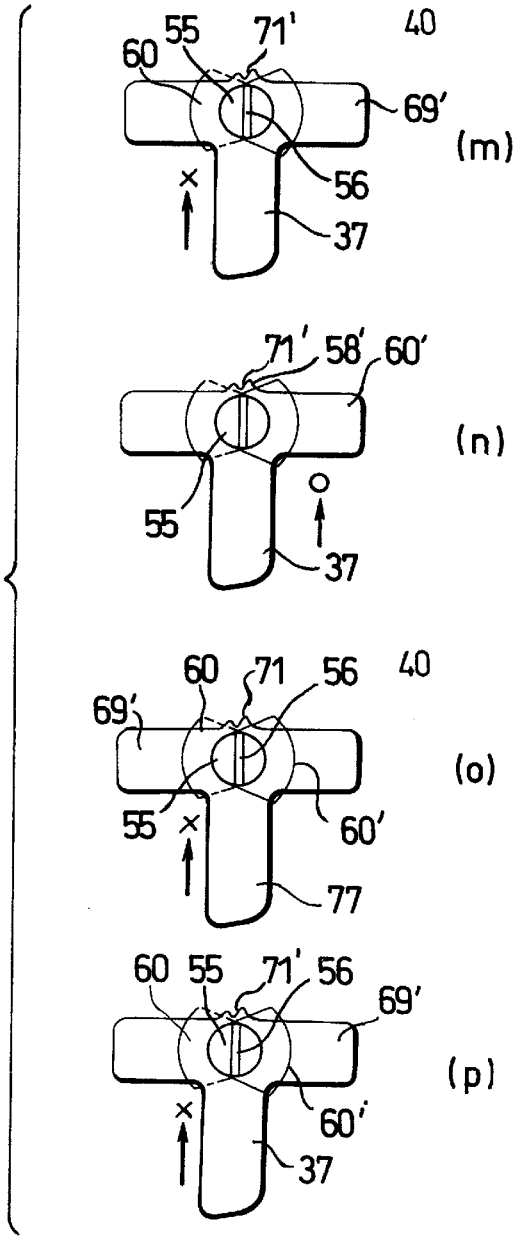
FIGS. 8(*m*)–8(*p*) are plan views showing positions of a stopper flange of the button body and a slide notch of the key plate wherein: (*m*) is a top plan view showing a non-pushed-in condition of the button body in the stored condition; (*n*) is a bottom view showing the pushed-in condition; (*o*) is a view of the button body and the slide notch of the key plate in the non-stored condition; and (*p*) is a bottom view showing an engaged condition.

In FIG. 8, a mark "x", pointed out by an upward arrow, indicates a condition in which the key plate 40 cannot slide. A circle mark, also pointed to by an upward arrow, indicates a condition in which the key plate can slide.

As shown in FIGS. 9(*q*), (*r*) and (*s*), for the slide notch 37 of the key plate 40, the obtuse-angle shoulder portions 58' of the upper and lower stopper flanges 60 and 60' are engaged with the shoulder portion on the end portion of the slide notch 37, and also engaged with the triangular protrusion 71 formed on the bottom of the central portion of one face of an annular sub notch 34' in the rear face of the button presser plate 36 and the triangle protrusion 71' formed on the end portion of the slide notch 37 of the key plate 40. This is true in either condition (*r*) or (*s*).

In this manner, the relative sliding of the button body 54 and the key plate 40 is inhibited, and the function is inhibited from being deteriorated by excess wear of the shoulder portions and the protrusions 71 and 71'.

As shown in FIG. 13, on the rear face of the button presser plate 36, opposite square lock notches 69 are formed on opposite sides of the button passing button hole 34, while similar square lock notches 69' are also formed on opposite sides of the slide notch 37 of the key plate 40. When the button body 54, shown in FIG. 5(*k*), is inserted through the button hole 34 and slide notch 37 of the button presser plates 36 and the key plate 40 for assembly, opposite fork portions 63' of a fork-shaped button presser washer 63 in the cover button 10 are inserted through the lock notches 69 and 69'. This inhibits the lever handle 7" from being turned from the outside with evil or criminal intent to slide the key plate 40 via the rotary cam 47 shown in FIG. 2 and use the clearance created to search for the keyword to unlock the lock.

Figure 12:
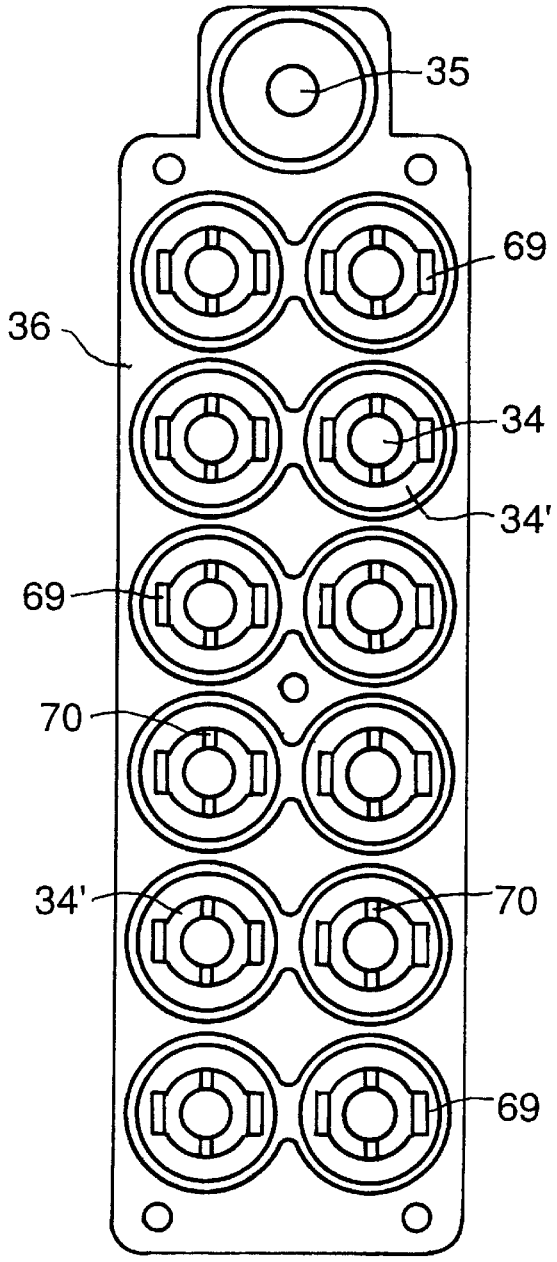
FIG. 12 is a front plan view of the button presser

Therefore, in the button presser plate 36, as shown in FIG. 12, the annular sub notch 34' is formed adjacent and around the button hole 34 in the predetermined depth, and the triangular protrusion 71 having half the depth of the annular sub notch 34' from its surface is formed on the bottom of the sub notch 34' as aforementioned and as shown in FIG. 9(*q*). As shown in FIG. 9(*r*), in the stored condition of the button body 54 the shoulder portions 58 of the upper and lower stopper flanges 60 and 60' in the stored condition are engaged with both the triangular protrusion 71 of the button presser plate 36 and the triangle protrusion 71' of the key plate 40, so that the key plate 40 does not slide relative to the button bodies 54.

As shown in FIG. 9(*s*), for the keyword for pushing the button body 54 in the stored condition against the elastic spring 64, the stopper flange 60' shown in FIG. 8 passes the slide notch 37 of the key plate 40 while the other stopper flange 60 passes the slide notch 37, thereby permitting the key plate 40 to slide relative to the button body 54.

In FIGS. 9(*r*) and (*s*), the shanks 62 and 55 are omitted for convenience of illustration.

When the button body 54 is assembled or set, as shown in FIGS. 5(*k*), 6 and 7, first the button washer 63 is inserted in the cover button 10, then the straight elastic spring 64 is inserted and a washer 65 is placed with grease into the annular sub notch 34' of the button presser plate 36 to be prevented from falling off. Subsequently, the shank 62 of the button body 54 is inserted in a square hole 65' (see FIG. 5(*k*)) in the washer 65, and the upper and lower stopper flanges 60 and 60' are inserted in the slide notch 37 of the key plate 40 and engaged with protrusion 71' and also with protrusion 71 of the button hole 34 of the button presser plate 36 thereby engaging button bodies 54 to corresponding plates 40, 36. Subsequently, the button body 54 is set between the base plate 446 and the reset plate presser plate 446' of the reset plate 43 and fixed via the lock spring 66' of the torsion spring extended via the stopper pin 66. Lastly, by setting the button back plate 46 via the tapered spring 67, the button body 54 is set and assembled. To assemble the clear button 48, as shown in FIG. 5(L), the straight spring 64 is assembled via a protection cover 68 into the cover button 10', the shank portion 50 is inserted through the hole in the cam frame 42 of the reset plate 43, the tapered face of the cam flange 52 is engaged with the cam face 42' of the cam frame 42, and lastly the tapered spring 67 is interposed between the reset plate 43 and the back plate 46 to apply an elastic force, thereby completing the assembly.

Figure 19:
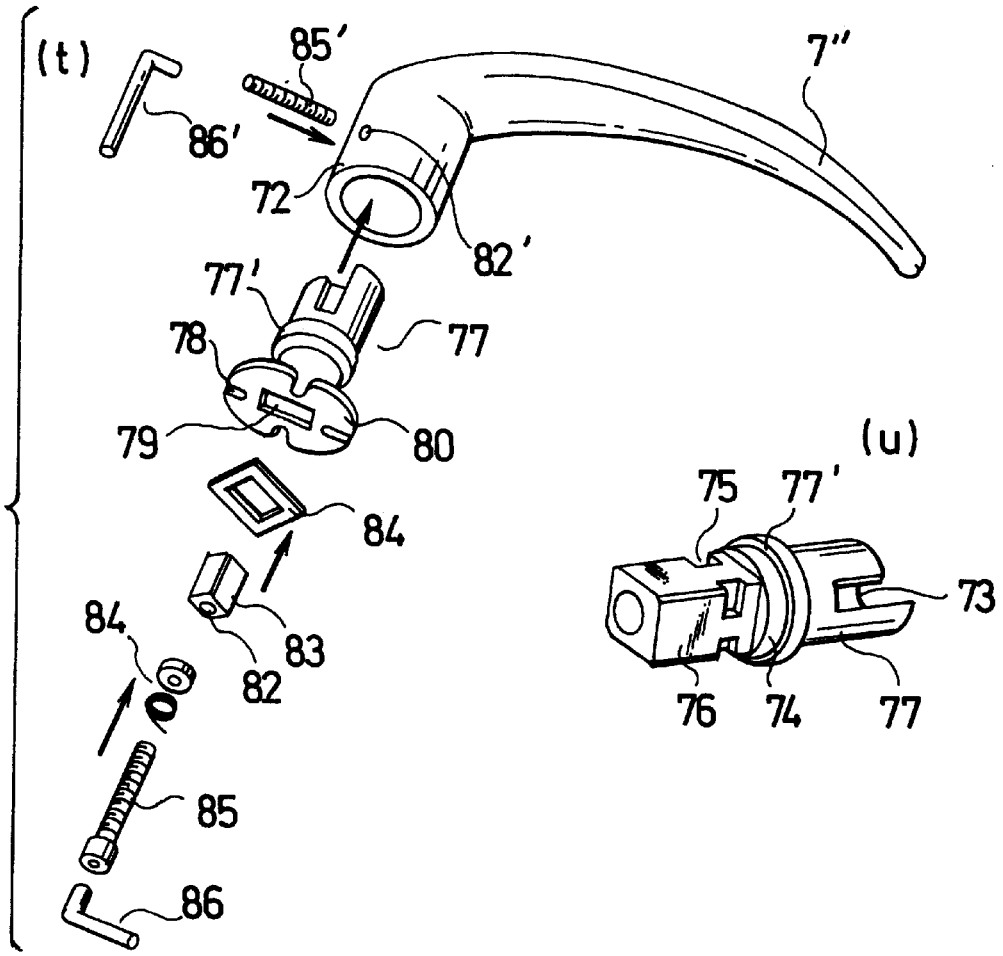
FIGS. 19(*t*) and 19(*u*) are partial views of an outer lever handle wherein: (*t*) is an exploded perspective view thereof; and (*u*) is a perspective view schematically showing a rotation shaft thereof.
Figure 20:
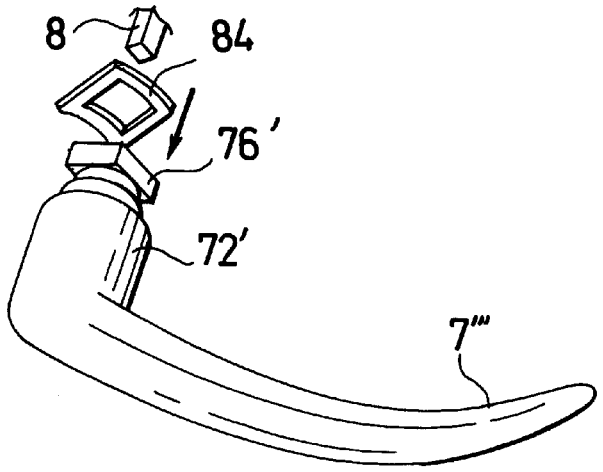
FIG. 20 is a perspective view showing engagement of an inner lever handle.

To prevent the unexpected extraction of the outside lever handle 7" with evil intent or the like and optionally switch the right-handed or left-handed operation, as shown in FIGS. 19(*t*) and (*u*) rotation shaft 77 having a shaft notch 73 in its side is inserted into a lever base 72 of the lever handle 7", a lever stopper washer 80 is inserted to a shaft notch 74 formed in the substantially middle portion of the rotation shaft 77' relative to the rotation shaft 77', and a lever stopper snap washer 84 is inserted to a notch 75 adjacent to notch 74 to hold handle 7" engagement as shown in FIG. 20. Furthermore, a lever shaft 83 is inserted to the rotation shaft 77 and a square hole 79 of the lever stopper washer 80, a bolt 85 for a hexagonal spanner is screwed in via a washer 84, and the entire component is fixed integrally to the lever base 72 of the lever handle 7" with a hexagonal spanner 86. For the shaft notch 73 of the rotation shaft 77 , a screw 85' is inserted into a screw hole 821 formed in the lever base 72 via a hexagonal spanner 86' and selectively into the notches 73 opposite to each other in a phase of 180°, and fastened. The lever handle 7" is thus rotatably provided relative to the rotation shaft 77, and fastened and fixed for the right-handed or left-handed operation condition or securely prevented from falling off by an axial reaction force exerted by the lever stopper washer 80 and the snap washer 84 attached to the rotation shaft 77. Therefore, the extraction of the lever handle 7" intentionally or with criminal intent can be inhibited, and the lever handle can be optionally applied for the right-handed or left-handed operation.

As shown in FIG. 20, the lever handle 7'" of the sub backing plate 4' on the rear side of the door is also prevented from being extracted via the snap washer 84 attached to the rotation shaft relative to the base 72' or is rotatably provided in the same manner as aforementioned.

Figure 6:
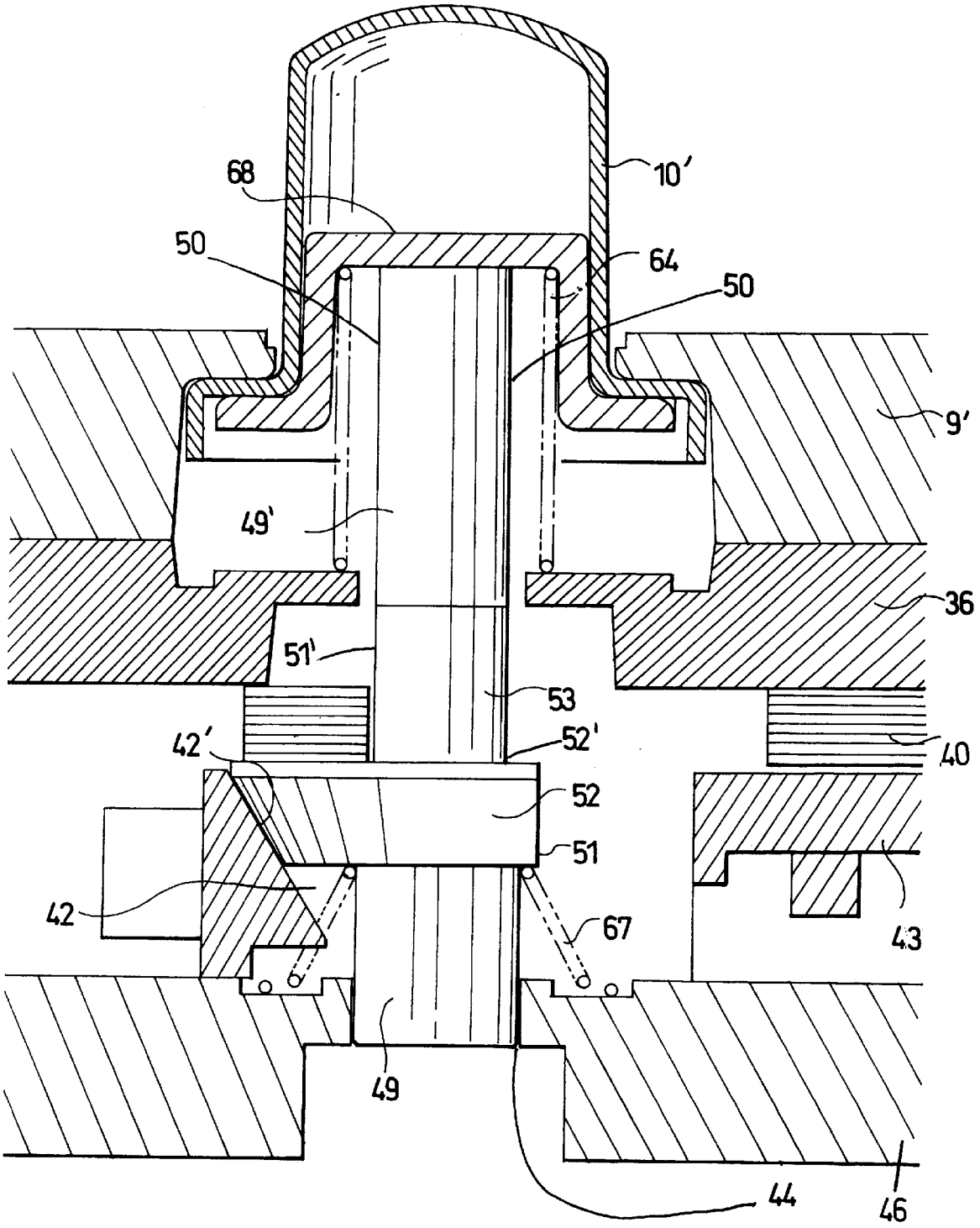
FIG. 6 is a sectional view showing an action of the clear button relative to a reset plate.

The condition where the clear button 48 is thus assembled is shown in FIG. 6 while the condition where each button body 54 is assembled is shown in FIG. 7, and the left half of FIG. 7 is a sectional view of the non-stored condition while the right half is a sectional view of the stored condition.

By rotating 180° with a screwdriver or the like the screwdriver notch 56 of the shank 55 of the button body 54 opposite to the cover button 10' visible in the button hole 44 with the keyword 1 to 0, A or B placed on the side of the button hole 44 of the back plate 46 which serves as a back plate in the stored condition, the keyword of the stored condition can be set. It can be visually confirmed whether the button body 54 of the keyword is in the stored condition or in the non-stored condition by placing a red, black or another mark on one side or the other side of the screwdriver notch 56 of the shank 55 shown in FIG. 4(*f*). Specifically, when the right half is colored in black or the like, it can be visually confirmed that the keyword is in the stored condition (not shown in the drawings).

Additionally, in FIGS. 14 and 16 numeral 64' denotes return biasing springs of the key plate 40 and the reset plate 43.

In the aforementioned constitution, at the time of initial assembly, in accordance with a keyword ordered by a purchaser a constructor turns 180° the screwdriver notch 56 of the shank 55 opposite to the cover button 10 of the button body 54 visible in the button hole 44 of the back plate 46 of the button body 54 to set the predetermined stored condition. In this case, relative to the key plate 40 in the case frame 2' the upper and lower stopper flanges 60 and 60' of the button body 54 in the stored condition are inserted in notches 37 as shown in FIG. 8(m) and FIG. 9(*r*), while the upper and lower stopper flanges 60 and 60' of the button body 54 in the non-stored condition have the condition shown in FIG. 8(*o*). One of the stopper flanges 60 and 60' is engaged with the triangle protrusion 71 of the slide notch 37 of the key plate 40, while the other stopper flange 60' is engaged with the triangular protrusion 70 formed midway in the depth of the button hole 34 of the button pressure plate 36 and inhibited from rotating. Therefore, in this condition even if the lever handle 71" is turned to an unlocking direction (to the right R in the case of the right-handed operation and to the left L in the case of the left-handed operation), the rotary cam 47 cannot slide the key plate 40. Therefore, the square mandrel 8' is not turned, the dead bolt 5 of the deadlock 6 is not retreated, and thus the deadlock 6 cannot be unfastened.

Additionally, even when the keyword of the stored condition is searched with criminal intent to unlock the lock by turning with a force the lever handle 7" to slide the key plate 40, the keyword of the stored condition cannot be found because the fork portion 63' of the button stopper washer 63 is engaged with the lock notches 69 and 69' of the button presser plate 36 and the key plate 40 so that the lever handle and the key plate are kept in fixed condition.

When a user himself unlocks and opens the door, by pushing the cover buttons 10' of the cover plate 9' in accordance with the keyword of the stored condition, the upper and lower stopper flanges 60 and 60' of the button body 54 change conditions from FIG. 8(*m*) to FIG. 8(*n*) and FIG. 9(*s*). The stopper flanges are disengaged from the triangle protrusion 71' of the slide notch 37 in the key plate 40 and the triangular protrusion 71 of the presser plate 36, and are engaged with the slide notch 37. For the button body 54 in the non-stored condition, by rotating the lever handle 7" in the predetermined direction while the stopper flanges 60 and 60' are not engaged with the slide notch 37, the key plate 40 slides via the rotary cam 47 by the predetermined distance against the spring 64 without interfering with each button body 54. Therefore, the rotary cam 47 is rotated, the deadlock 6 is unfastened, the dead bolt 5 retreats and the door can be opened.

During the operation, by pushing the button body 54 of the keyword of the stored condition via the cover button 10', the button body 54 pushed in accordance with the keyword of the stored condition has the condition shown in FIG. 5(*k*), and the lock spring 66' is engaged in the slit or annular lock spring notch 61 to realize the locked condition. The pushed-in button body 54 is held in the locked condition without being returned.

To return the stored button body 54 to the non-stored condition, by pushing the clear button 48 via the cover button 10', as shown in FIGS. 16 to 18 the lock flange 52 is engaged with the cam face 42' of the lock frame 42 of the reset plate 43 as shown in FIG. 6. By sliding the reset plate 43, the lock spring 66' is disengaged from the tapered lock flange 57 of each button body 54. Therefore, each button body 54 is returned to its initial attitude by the elastic force of the spring 64.

Additionally, since the button body 54 in the non-stored condition is not pressed in as shown in the left half of FIG. 7, the clear button body 54 is in the reset condition even if the clear button body 54 pushed. In this case, all the button bodies 54 have reset attitudes in the non-stored condition.

When the door is locked and closed again, the user pushes in the cover buttons 10 of the cover plate 9 having keyword numbers in accordance with the stored keyword, so that each lock spring notch 61 of the tapered lock flange 57 is engaged with the lock spring 66' and the pushed-in locked condition is kept. In this case, when the lever handle 7" is rotated in the locking direction, the key plate 40 in the engaged condition slides by the predetermined distance without interfering with the button body 54 in the same manner as in the locking condition. The deadlock 6 is rotated in the locking direction via the square mandrel 8, the dead bolt 5 advances and the intrinsic locking/unlocking function is completed.

When the button lock 1' cannot be locked/unlocked in an unexpected situation, by inserting a master key (not shown) via master key holes 32 and 32', the deadlock may be locked/unlocked.

When the keyword in the unexpected condition is changed for the user's convenience, by rotating 180° toward the stored condition the screwdriver notch 56 of each button body 54 which can be visually confirmed by using keyword numerals and characters placed beside the button holes 44 of the back plate 46 on the rear side of the case frame 2' provided on the surface of the dead bolt, the keyword of the stored condition can be optionally changed.

Additionally, it is natural that the mode of practicing the present invention is not limited to the embodiment mentioned above. For example, the handle is not limited to the lever handle but may be, for example, of a knob type or a thumb turning type. In respect of design change, naturally, the fan shape of the stopper flange of the button body can be appropriately changed. Additionally, to form the button body or the cover button of hard rubber or resin or the like is in the range of the design change.

Furthermore, the door to which the invention is applied is not limited to the double-hinged type, and the invention can be naturally applied to a sliding type door.

As aforementioned, according to the present invention, the dead bolt of the deadlock basically embedded in the door can advance or retreat optionally, and by pushing the buttons in accordance with the keyword designed beforehand, the deadlock can be locked/unlocked. Therefore, laborious key operation is unnecessary, and no trouble in locking/unlocking is caused by leaving behind the key. The locking/unlocking can be easily performed, and the deadlock is advantageously reliable in respect of prevention of crimes.

At the time of locking, key operation is unnecessary, button operation is also unnecessary and a so-called fastening facility is advantageously provided.

Additionally, the button body, the cover button, the lock spring and the like can be produced of the same size of the convenience of assembly. Mass productivity is enhanced, cost can be reduced, and the components can be used in common. Just by coloring one side of the screwdriver notch 56 of the button body or by other methods, the keyword of the button stored condition can be optionally selected.

In the present invention, by selecting the combination of the keyword of the button-body stored condition beforehand, the button keyword of the stored or non-stored condition can be selectively determined or not determined. As aforementioned, the mass productivity is enhanced and the cost can be reduced. Furthermore, degree of freedom can be provided for facilitating the selective combination of the keyword. Specifically, the same combination number of the keyword can be used for assembly through manufacture and wholesale processes, and the user can easily change the combination of the keyword as required. The degree of freedom for assembly or use is thus advantageously enhanced.

The shank of the button body is formed in a bar shape, and two stopper flanges formed on the shank are engaged with the slide notch 37 of the key plate 40 in such manner that the button body is releasably engaged. Only when the button body is engaged with and intersects the key plate, the key plate can slide relative to the button body. Even when the button body is engaged with the key plate, the key plate can slide only while the upper and lower stopper flanges of the button body are engaged with the angle protrusion formed on one end of the slide notch 37 of the key plate 40 and the triangular protrusion formed on the other end of the button hole 34 of the button presser plate 36 which slides relative to the key plate. In this manner, the rotation of the button body is absolutely prevented double, and the button body is inhibited from being rotated by pushing the button body unexpectedly, intentionally or with criminal intent. Even when key plate is forced to be slid by means of rotation of the handle, double engagement of the two stopper flanges with the hook notches inhibits the relative sliding of the key plate and the button body. Therefore, even in the key plate of zinc, engagement portions are not worn. Consequently, durability is advantageously enhanced.

Moreover, since the key plate is slidably inserted between the button presser plate and the reset plate which slide relative to the key plate and the elastic spring is interposed, the key plate cannot be freely slid even by freely rotating the handle in an unexpected manner. Therefore, the key plate can be slid by rotating the handle only for operation.

Since the snap washer is attached to the rotation shaft of the handle, the handle cannot be easily extracted. Therefore, the handle cannot be removed and taken away intentionally or with criminal intent, which is effective as a safety measure for prevention of crimes. Since the rotation shaft of the handle is attached with the screw bolt, the handle is prevented from being extracted intentionally or with criminal intent as aforementioned. Additionally, the right-handed or left-handed operation of the handle can be selectively performed only by switching and tightening the screw bolt.

Since the button washer is inserted via the spring between the key plate and the button presser plate, the keyword and the button in the stored condition cannot be searched successively by moving the key plate slightly via the handle with evil or criminal intent. In this respect, crimes can be advantageously prevented, and safety is relatively high.

Furthermore, by classifying one side of the screwdriver notch 56 for rotating the button with color and rotating the screwdriver notch of the button with the screwdriver 180° from the rear-plate side, the keyword of the stored condition can be easily changed or set.

Additionally, one of the buttons can be provided as the clear button for releasing the buttons. When the buttons are wrongly pushed in against the keyword, by pushing the clear button, the reset plate is slid by the predetermine distance in such a manner that all the buttons are released from locked condition. The hook notches of the key plate and the button presser plate or other engagement portions are prevented from being damaged when the handle is rotated. Therefore, the durability of the mechanical portions of the button lock is enhanced, and unexpected trouble or the like is not caused.

The buttons can be reset to the initial condition with the clear button. Even when the buttons are pushed in by mistake, by again pushing the correct buttons of the stored condition in accordance with the keyword, the key plate can be slid via the rotary cam by rotating the handle. The deadlock can thus be normally fastened.

As aforementioned, since the key plate and the button presser plate have good durability, zinc products can be manufactured and, therefore, metal molds or the like can be circulated for use. Molding/processing can be easily performed, and a reduction in raw-material cost can be maintained.

Different from the prior art, the button body is not formed in a plate shape but in a bar shape. The button body does not need to be switched to the erected or inverted condition, i.e., the stored or non-stored condition. Simply by rotating the button body via the screwdriver notch, the stored or non-stored condition can be detected, which is advantageous in operation. Additionally, by rotating the button body 54 via the screwdriver notch 56 through 1800 in accordance with the keyword, the stored or non-stored condition can be switched. In the same manner as the conventional rotary button, the switching angle is larger than 90°. Therefore, a large degree of freedom exists in the engagement of the key plate with the two-step stopper flanges of the button body. The engagement portions are hardly worn in the sliding condition except when the button body is locked or when the key plate relatively slides. Consequently, even when zinc materials which can be mass-produced are used, excellent durability can be advantageously kept.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means and materials for carrying out various disclosed functions may take a variety of alternative forms without departing from the invention.

Thus the expressions "means to . . . " and "means for . . . " as may be found in the specification above and/or in the claims below, followed by a functional statement, are intended to define and cover whatever structural, physical, chemical or electrical element or structure may now or in the future exist which carries out the recited function, whether or not precisely equivalent to the embodiment or embodiments disclosed in the specification above; and it is intended that such expressions be given their broadest interpretation.

The reference numerals are

1' button lock
2' case frame
3 pipe bridge
5 dead bolt
6 deadlock
7, 7" lever handle
8, 8' square mandrel
9' cover plate
10' cover button
11 plate tumbler
12 slit notch
13 hook notches
13' slide notches, upper slide notch
17 slide notch in key plate 16
19 screwdriver notch
23 lower reset plate slide notch
25 annular notch
32, 32' key notches
34 button hole
34' annular sub notch
36 button presser plate
37 slide notch
40 key plate
42' cam face
43 reset plate
44 button hole in back plate 46

46 back plate
47 rotary cam
48 clear button
54 button body
56 screwdriver notch
57 tapered lock flange
58 flat face of stopper flange 60, 60'
58' obtuse-angle shoulder portions
60 upper stopper flange
60' lower stopper flange
61 lock notch/slit atop tapered lock flange 57
63 button stopper washer
64 spring
64 (elastic) spring
66' lock spring
66 stopper pin (FIG. 17)
69, 69' square lock notch
71, 71' protrusion or angle protrusion
72 lever base
73 shaft notch
74 annular shaft notch
cylindrical head (FIG. 23)
75 notch (adjacent notch 74)
77 rotation shaft, fork-shaped (FIG. 2)
79 square hole
81 handle fixing washer
85 screw bolt
85' fixing screw
81 snap washer

What is claimed is:

1. A button lock mountable on a door surface and comprising:

a plurality of button bodies (54);

cover buttons (10') covering the button bodies;

said cover buttons (10') being exposed on a cover plate (9') of a case frame (2') mountable on the door surface housing said button bodies;

said button bodies being settable in an arrangement in accordance with a keyword for unlocking a dead bolt of a deadlock and disengageably engaged with a key plate (40) which is slidable in the case frame;

a handle cooperatingly engaged with the case frame and a backing plate and being engaged via a square mandrel with said deadlock;

wherein each of said button bodies is bar-shaped and includes integral upper and lower stopper flanges (60, 60');

wherein the key plate (40) includes a predetermined number of slide notches (37), the button bodies being releasably inserted therein, the slide notches being formed in predetermined positions in the key plate, the key plate being slidably laminated onto a button presser plate (36) within said case frame;

each of said button bodies loosely inserted in the slide notch of the key plate being slidable to advance or retreat orthogonally in the case frame;

a screwdriver notch (56) being formed in a tip end of each of the button bodies for determining a selective attitude of the button bodies between one turned attitude in which button bodies intersect the key plate to inhibit the key plate from advancing or retreating and another turned attitude in which the key plate is permitted to advance or retreat, each of the button bodies being releasably engaged with a button reset plate (43);

the handle engaged with said deadlock being engaged via a rotary cam (47) with the key plate and the reset plate;

a fixing screw (85') being provided for selectively fixing the handle relative to a rotation shaft of the rotary cam for right-handed or left-handed operation; and a clear lock button of the key plate being provided on the cover plate of said case frame.

2. The button lock according to claim 1 wherein a plurality of protrusions (71') are formed in said key plate and respectively engage with stopper flanges of each of said button bodies.

3. The button lock according to claim 2 wherein each of said protrusions is formed in a triangle shape.

4. The button lock according to claim 1 wherein said key plate is slidably interposed between the button presser plate and the button reset plate.

5. The button lock according to claim 4 wherein said button reset plate includes a lock spring (66') for engagment of a lock spring notch (61) of the button body.

6. The button lock according to claim 1 wherein said clear lock button includes a cam face formed thereon to unlock each of said button bodies in the button reset plate.

7. The button lock according to claim 1 wherein an elastic lock spring (66') on the button reset plate is interposed along the button body.

8. The button lock according to claim 1 wherein said rotation shaft is provided with a snap washer for preventing the handle from being extracted.

9. The button lock according to claim 1 wherein said rotation shaft is attached via a screw bolt (85) to a base of the handle.

10. The button lock according to claim 1 wherein a button washer (63) is attached along the button body (54) via a spring (64) to engage notches (69, 69') of said key plate and the button presser plate.

* * * * *